US008012073B2

(12) United States Patent
Barnett

(10) Patent No.: US 8,012,073 B2
(45) Date of Patent: Sep. 6, 2011

(54) FITNESS MACHINE WITH AUTOMATED VARIABLE RESISTANCE

(76) Inventor: Michael Charles Barnett, Chesnee, SC (US)

( * ) Notice: Subject to any disclaimer, the term of this patent is extended or adjusted under 35 U.S.C. 154(b) by 0 days.

(21) Appl. No.: 12/644,120

(22) Filed: Dec. 22, 2009

(65) Prior Publication Data

US 2011/0152032 A1 Jun. 23, 2011

(51) Int. Cl.
*A63B 26/00* (2006.01)
*A63B 24/00* (2006.01)

(52) U.S. Cl. ..... 482/142; 482/4

(58) Field of Classification Search ..... 482/4, 5, 482/7, 133, 135–137, 142–145
See application file for complete search history.

(56) References Cited

U.S. PATENT DOCUMENTS

| | | | |
|---|---|---|---|
| 1,693,810 | A | 12/1926 | Daniels et al. |
| 1,703,104 | A | 2/1929 | Hassler |
| 2,046,653 | A | 7/1936 | Petcoff |
| 2,450,430 | A | 10/1948 | Hight |
| 2,498,006 | A | 2/1950 | Ridill |
| 2,640,480 | A | 6/1953 | Hill |
| 2,915,057 | A | 12/1959 | Ammon |
| 3,081,085 | A | 3/1963 | Girolamo |
| 3,286,708 | A | 11/1966 | Gartner |
| 3,358,679 | A | 12/1967 | Borrelli |
| 3,388,700 | A | 6/1968 | Mountz |
| 3,519,268 | A | 7/1970 | McQueen |
| 3,618,942 | A | 11/1971 | Bates et al. |
| 3,652,085 | A | 3/1972 | Cole |
| 3,677,543 | A | 7/1972 | Richardson |
| 3,685,511 | A | 8/1972 | Alvarez |
| 3,722,507 | A | 3/1973 | Krause |
| 3,752,154 | A | 8/1973 | Clark |
| 3,807,730 | A | 4/1974 | Dalton et al. |
| 3,857,561 | A | 12/1974 | Cecchini et al. |
| 3,870,317 | A | 3/1975 | Wilson |
| 3,876,200 | A | 4/1975 | Bush et al. |
| 3,948,513 | A | 4/1976 | Pfotenhauer |
| 3,998,218 | A | 12/1976 | Lane et al. |
| 4,019,734 | A | 4/1977 | Lee et al. |
| 4,103,681 | A | 8/1978 | Shanley |
| 4,113,250 | A | 9/1978 | Davis |
| 4,176,836 | A | 12/1979 | Coyle |
| 4,207,879 | A | 6/1980 | Safadago et al. |
| 4,232,662 | A | 11/1980 | Barber |
| 4,235,437 | A | 11/1980 | Ruis et al. |
| 4,247,096 | A | 1/1981 | Schmitt |
| 4,292,962 | A | 10/1981 | Krause |
| 4,304,401 | A | 12/1981 | Goodman |
| 4,311,305 | A | 1/1982 | Lambert, Jr. et al. |
| 4,328,964 | A | 5/1982 | Walls |
| 4,340,218 | A | 7/1982 | Wilkinson |

(Continued)

*Primary Examiner* — Allana Lewin
(74) *Attorney, Agent, or Firm* — Turner Padget Graham & Laney

(57) ABSTRACT

A fitness machine is provided, which includes a base frame having a pair of vertical side members; a track assembly rotatably mounted to the base frame between the vertical side members; a drive assembly for rotating the track assembly relative to the base frame; a bench rest assembly slidably mounted to the track assembly for supporting a user in a supine position; a handle assembly and a footrest assembly fixedly attached to the track assembly; and a control system for directing the drive assembly to alter the angular orientation of the bench rest assembly to vary the resistance experienced by a user during an exercise routine. The operation may be manual, programmable, or adaptive to the user's performance, based on repetition time and/or heart rate.

18 Claims, 16 Drawing Sheets

U.S. PATENT DOCUMENTS

| | | | | |
|---|---|---|---|---|
| 4,354,676 | A | | 10/1982 | Ariel |
| 4,356,577 | A | | 11/1982 | Taylor et al. |
| 4,357,011 | A | | 11/1982 | Voris |
| 4,358,108 | A | | 11/1982 | Voris |
| 4,364,556 | A | | 12/1982 | Otte |
| 4,372,552 | A | | 2/1983 | Carlmark |
| 4,377,281 | A | | 3/1983 | Jesernig et al. |
| 4,391,443 | A | | 7/1983 | Beecroft |
| 4,410,176 | A | | 10/1983 | Miller |
| 4,411,423 | A | | 10/1983 | Estwanik, III |
| 4,419,989 | A | | 12/1983 | Herbold |
| 4,444,178 | A | | 4/1984 | Kuo |
| 4,461,287 | A | | 7/1984 | Takahashi |
| 4,494,532 | A | | 1/1985 | Masuda et al. |
| 4,494,533 | A | | 1/1985 | Sgroi et al. |
| 4,502,682 | A | | 3/1985 | Miller |
| 4,503,845 | A | | 3/1985 | Licciardi |
| 4,515,152 | A | | 5/1985 | Teeter |
| 4,523,582 | A | | 6/1985 | Barber |
| 4,531,731 | A | | 7/1985 | Law |
| 4,534,554 | A | | 8/1985 | Miller |
| 4,534,555 | A | | 8/1985 | McGowen |
| 4,537,395 | A | | 8/1985 | Spinelli |
| 4,544,155 | A | | 10/1985 | Wallenbrock et al. |
| 4,546,764 | A | | 10/1985 | Gerber |
| 4,546,972 | A | | 10/1985 | Goyer |
| 4,566,693 | A | | 1/1986 | Seidentop et al. |
| 4,576,377 | A | | 3/1986 | Wolff |
| 4,598,907 | A | | 7/1986 | Ross |
| 4,609,193 | A | | 9/1986 | Paris et al. |
| 4,618,144 | A | | 10/1986 | Gibson |
| 4,620,701 | A | | 11/1986 | Mojden |
| 4,622,980 | A | | 11/1986 | Kunig |
| 4,624,458 | A | | 11/1986 | Fendrik |
| 4,627,422 | A | | 12/1986 | Bates |
| 4,635,933 | A | | 1/1987 | Schnell |
| 4,635,934 | A | | 1/1987 | Roethke |
| 4,645,205 | A | | 2/1987 | Wolff |
| 4,669,724 | A | | 6/1987 | Matheisen |
| 4,672,697 | A | | 6/1987 | Schurch |
| 4,690,133 | A | | 9/1987 | George |
| 4,703,929 | A | | 11/1987 | Reed |
| 4,709,923 | A | | 12/1987 | Gibson |
| 4,717,148 | A | | 1/1988 | Brewer |
| 4,726,358 | A | | 2/1988 | Brady |
| 4,753,438 | A | | 6/1988 | Paris et al. |
| 4,757,993 | A | | 7/1988 | Rake |
| 4,776,587 | A | | 10/1988 | Carlson et al. |
| 4,785,674 | A | | 11/1988 | Ormon et al. |
| 4,789,152 | A | | 12/1988 | Guerra |
| 4,804,179 | A | | 2/1989 | Murphy et al. |
| 4,809,972 | A | | 3/1989 | Rasmussen et al. |
| 4,817,943 | A | | 4/1989 | Pipasik |
| 4,834,367 | A | | 5/1989 | Salyer et al. |
| 4,848,739 | A | | 7/1989 | Schaub et al. |
| 4,867,143 | A | | 9/1989 | Morin |
| 4,883,268 | A | | 11/1989 | Salkind |
| 4,884,804 | A | | 12/1989 | Fenwick |
| 4,890,604 | A | | 1/1990 | Nelson |
| 4,893,813 | A | | 1/1990 | Murray et al. |
| 4,900,018 | A | | 2/1990 | Ish, III et al. |
| 4,907,798 | A | | 3/1990 | Burchatz |
| 4,915,101 | A | | 4/1990 | Cuccia |
| 4,944,510 | A | | 7/1990 | Brady |
| 4,949,951 | A | | 8/1990 | Deola |
| 4,986,538 | A | | 1/1991 | Ish, III |
| 5,002,043 | A | | 3/1991 | George |
| 5,011,141 | A | | 4/1991 | Towley, III et al. |
| 5,044,358 | A | | 9/1991 | Morin |
| 5,116,044 | A | | 5/1992 | Wilkinson et al. |
| 5,118,096 | A | | 6/1992 | Wilkinson et al. |
| 5,123,886 | A | | 6/1992 | Cook |
| 5,125,884 | A | * | 6/1992 | Weber et al. ..... 482/145 |
| 5,163,439 | A | | 11/1992 | Dardik |
| 5,169,363 | A | | 12/1992 | Campanaro et al. |
| 5,173,855 | A | | 12/1992 | Nielsen et al. |
| 5,180,161 | A | | 1/1993 | Jordan |
| 5,226,868 | A | | 7/1993 | Montgomery |
| 5,248,286 | A | | 9/1993 | Wilkinson et al. |
| 5,263,913 | A | * | 11/1993 | Boren ..... 482/96 |
| 5,295,936 | A | | 3/1994 | Perry, Jr. |
| 5,312,314 | A | | 5/1994 | Stephan et al. |
| 5,354,251 | A | | 10/1994 | Sleamaker |
| 5,391,132 | A | | 2/1995 | Greenwald |
| 5,399,133 | A | | 3/1995 | Haber et al. |
| 5,409,438 | A | | 4/1995 | Jones et al. |
| 5,417,630 | A | | 5/1995 | Schultz |
| 5,419,751 | A | | 5/1995 | Byrd et al. |
| 5,437,589 | A | | 8/1995 | Habing |
| 5,441,469 | A | | 8/1995 | Chern |
| 5,458,548 | A | * | 10/1995 | Crossing et al. ..... 482/6 |
| 5,489,249 | A | | 2/1996 | Brewer et al. |
| 5,496,241 | A | | 3/1996 | Sellers |
| 5,536,225 | A | | 7/1996 | Neuberg et al. |
| 5,540,642 | A | | 7/1996 | Sprague |
| 5,551,937 | A | | 9/1996 | Kwo |
| 5,554,089 | A | | 9/1996 | Jones |
| 5,569,120 | A | | 10/1996 | Anjanappa et al. |
| 5,575,745 | A | | 11/1996 | Lin |
| 5,583,403 | A | | 12/1996 | Anjanappa et al. |
| 5,622,078 | A | | 4/1997 | Mattson |
| 5,624,353 | A | | 4/1997 | Naidus |
| 5,645,509 | A | | 7/1997 | Brewer et al. |
| 5,662,555 | A | | 9/1997 | Cloutier |
| 5,669,860 | A | | 9/1997 | Reyes |
| 5,674,168 | A | | 10/1997 | Wilkinson |
| 5,718,660 | A | | 2/1998 | Chen |
| 5,738,104 | A | | 4/1998 | Lo et al. |
| 5,738,611 | A | | 4/1998 | Ehrenfried et al. |
| 5,752,879 | A | * | 5/1998 | Berdut ..... 482/96 |
| 5,776,040 | A | | 7/1998 | Webb et al. |
| 5,795,276 | A | | 8/1998 | Almeda |
| 5,807,211 | A | | 9/1998 | Berryhill |
| 5,807,219 | A | | 9/1998 | Webber et al. |
| 5,816,372 | A | | 10/1998 | Carlson et al. |
| 5,842,961 | A | | 12/1998 | Davis |
| 5,876,314 | A | | 3/1999 | Sugimura |
| 5,885,197 | A | * | 3/1999 | Barton ..... 482/144 |
| 5,888,180 | A | | 3/1999 | Dewberry |
| 5,919,115 | A | | 7/1999 | Horowitz et al. |
| 5,954,621 | A | | 9/1999 | Joutras et al. |
| 5,956,465 | A | | 9/1999 | Takagi et al. |
| 5,967,954 | A | | 10/1999 | Habing |
| 5,967,956 | A | | 10/1999 | Teeter |
| 5,976,063 | A | | 11/1999 | Joutras et al. |
| 6,027,433 | A | | 2/2000 | Flynn |
| 6,030,325 | A | | 2/2000 | Ottoson et al. |
| 6,033,344 | A | * | 3/2000 | Trulaske et al. ..... 482/7 |
| 6,099,440 | A | | 8/2000 | Schurter et al. |
| 6,106,439 | A | | 8/2000 | Boland |
| 6,117,055 | A | | 9/2000 | Boland |
| 6,120,416 | A | | 9/2000 | Walker |
| 6,123,680 | A | | 9/2000 | Brummer |
| D432,600 | S | | 10/2000 | Szabo et al. |
| 6,149,560 | A | | 11/2000 | Kim |
| 6,162,153 | A | | 12/2000 | Perez et al. |
| 6,210,305 | B1 | | 4/2001 | Eschenbach |
| 6,213,923 | B1 | | 4/2001 | Cameron et al. |
| 6,231,489 | B1 | | 5/2001 | McBride et al. |
| 6,243,897 | B1 | | 6/2001 | Sumiya |
| 6,309,330 | B1 | | 10/2001 | Thornton |
| 6,319,213 | B1 | | 11/2001 | Tomac |
| 6,344,017 | B1 | | 2/2002 | Teeter |
| 6,422,982 | B1 | | 7/2002 | Retel |
| 6,440,042 | B2 | | 8/2002 | Eschenbach |
| 6,464,296 | B1 | | 10/2002 | Sumner |
| 6,602,168 | B2 | | 8/2003 | Duke |
| 6,626,805 | B1 | | 9/2003 | Lightbody |
| 6,632,160 | B2 | | 10/2003 | LaFond et al. |
| 6,634,996 | B2 | | 10/2003 | Jacobsen |
| 6,637,055 | B1 | | 10/2003 | Nanan |
| 6,683,587 | B2 | | 1/2004 | Gulsen |
| 6,685,607 | B1 | | 2/2004 | Olson |
| D490,868 | S | | 6/2004 | Tornabene |
| 6,742,892 | B2 | | 6/2004 | Liberman |
| 6,746,385 | B1 | | 6/2004 | Habing |
| 6,770,013 | B2 | | 8/2004 | Stillinger |

6,786,847 B1 * 9/2004 Morgan et al. ..... 482/6
6,790,163 B1 9/2004 Van De Laarschot et al.
6,811,522 B1 11/2004 McQuinn
6,814,691 B1 11/2004 Kuo
D499,457 S 12/2004 Kuo
6,837,651 B1 1/2005 Lin
6,869,243 B1 3/2005 Teeter
6,939,272 B1 9/2005 Wu
7,011,611 B1 3/2006 Ripley
7,029,426 B1 4/2006 Fuller, Sr.
7,052,448 B2 5/2006 Teeter
7,063,652 B1 6/2006 Teeter et al.
7,070,543 B1 7/2006 Rindfleisch
7,077,795 B2 7/2006 Chen
7,081,073 B1 7/2006 Smith
7,083,554 B1 8/2006 Lo Presti
7,108,641 B2 9/2006 Pertegaz-Esteban
7,112,167 B2 9/2006 Kim
7,118,518 B1 10/2006 Teeter
7,121,989 B2 10/2006 Kerry
7,125,372 B1 10/2006 Teeter et al.
7,125,389 B2 10/2006 Sin
7,160,233 B2 1/2007 Perez
7,166,064 B2 1/2007 Watterson et al.
7,181,793 B2 2/2007 Lee
7,204,790 B2 4/2007 Sleamaker
7,223,219 B2 5/2007 Liester
7,229,391 B2 6/2007 Francis
7,250,022 B2 7/2007 Dalebout et al.
D551,725 S 9/2007 Teeter
7,270,628 B2 9/2007 Campanaro et al.
7,280,871 B2 10/2007 Davis et al.
7,291,100 B2 11/2007 Dodge et al.
7,295,224 B2 11/2007 Busch et al.
7,303,517 B2 12/2007 Pandozy
7,306,549 B2 12/2007 Francis
7,331,908 B2 2/2008 Olsen
7,331,911 B2 2/2008 Webber et al.
7,335,140 B2 2/2008 Webber et al.
7,344,486 B2 3/2008 Casey et al.
7,361,128 B2 4/2008 Chen
7,374,521 B2 5/2008 Wang
7,390,289 B2 6/2008 Wu
7,452,311 B2 11/2008 Barnes et al.
D581,996 S 12/2008 Teeter et al.
D582,495 S 12/2008 Bench
7,468,024 B2 12/2008 Webber et al.
7,481,743 B2 1/2009 Matsubara et al.
7,482,050 B2 1/2009 Olson
7,507,192 B2 * 3/2009 Teeter et al. ..... 482/144
7,530,936 B1 5/2009 Hall
7,544,152 B2 6/2009 Dey et al.
7,544,157 B2 6/2009 Teeter et al.
7,546,809 B2 6/2009 Chen
7,549,949 B2 6/2009 Webber et al.
7,556,590 B2 7/2009 Watterson et al.
7,563,214 B2 7/2009 Webber et al.
7,575,541 B2 * 8/2009 Chen ..... 482/144
7,585,264 B1 9/2009 Wang et al.
7,594,880 B2 9/2009 Webber et al.
7,594,891 B2 9/2009 Moore
7,597,656 B2 10/2009 Trees
7,608,031 B2 10/2009 Kerry
2003/0162639 A1 8/2003 Hsien
2003/0225351 A1 12/2003 Wu
2004/0063551 A1 4/2004 Lightbody
2004/0157714 A1 8/2004 Huang
2004/0158181 A1 8/2004 Watanabe et al.
2005/0090769 A1 4/2005 Chen
2005/0101464 A1 5/2005 Campitelli
2006/0046915 A1 3/2006 Huang
2006/0100072 A1 5/2006 Kerry
2006/0189451 A1 8/2006 Nelson
2007/0032358 A1 2/2007 Chen
2007/0043308 A1 * 2/2007 Lee ..... 601/34
2007/0078324 A1 4/2007 Wijisiriwardana
2007/0149364 A1 6/2007 Blau et al.
2007/0197274 A1 8/2007 Dugan
2007/0208392 A1 9/2007 Kuschner et al.
2008/0020912 A1 1/2008 Dalebout et al.
2008/0119763 A1 5/2008 Wiener
2008/0176713 A1 7/2008 Brizzio
2008/0176721 A1 7/2008 Boren
2008/0177211 A1 7/2008 Boren
2008/0214360 A1 9/2008 Stirling et al.
2008/0254944 A1 10/2008 Muri et al.
2009/0023556 A1 1/2009 Daly et al.
2009/0054216 A1 2/2009 Teeter
2009/0054217 A1 2/2009 Teeter
2009/0124473 A1 5/2009 Teeter et al.
2009/0181834 A1 7/2009 Campanaro et al.
2009/0181835 A1 7/2009 Campitelli

* cited by examiner

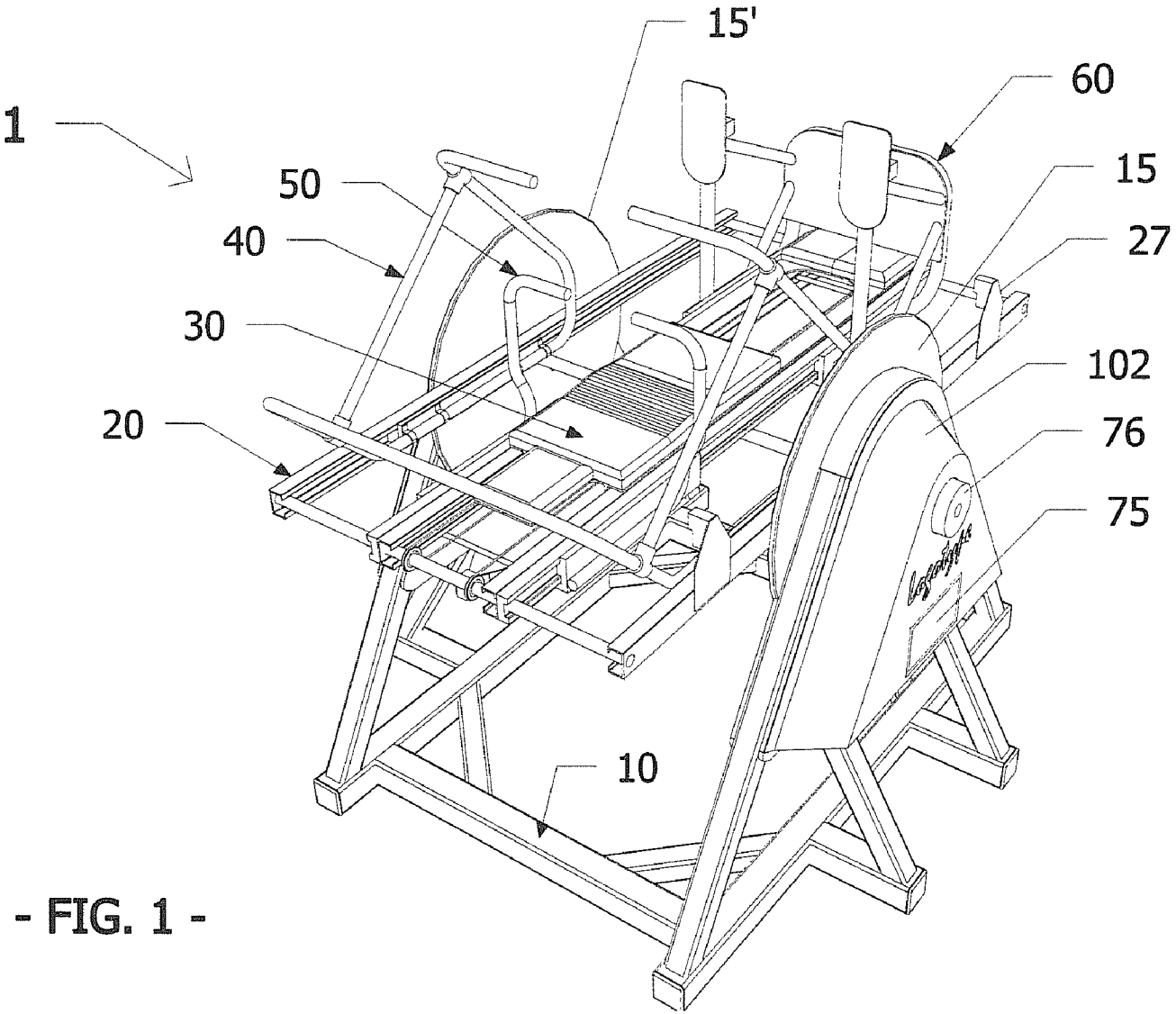
- FIG. 1 -

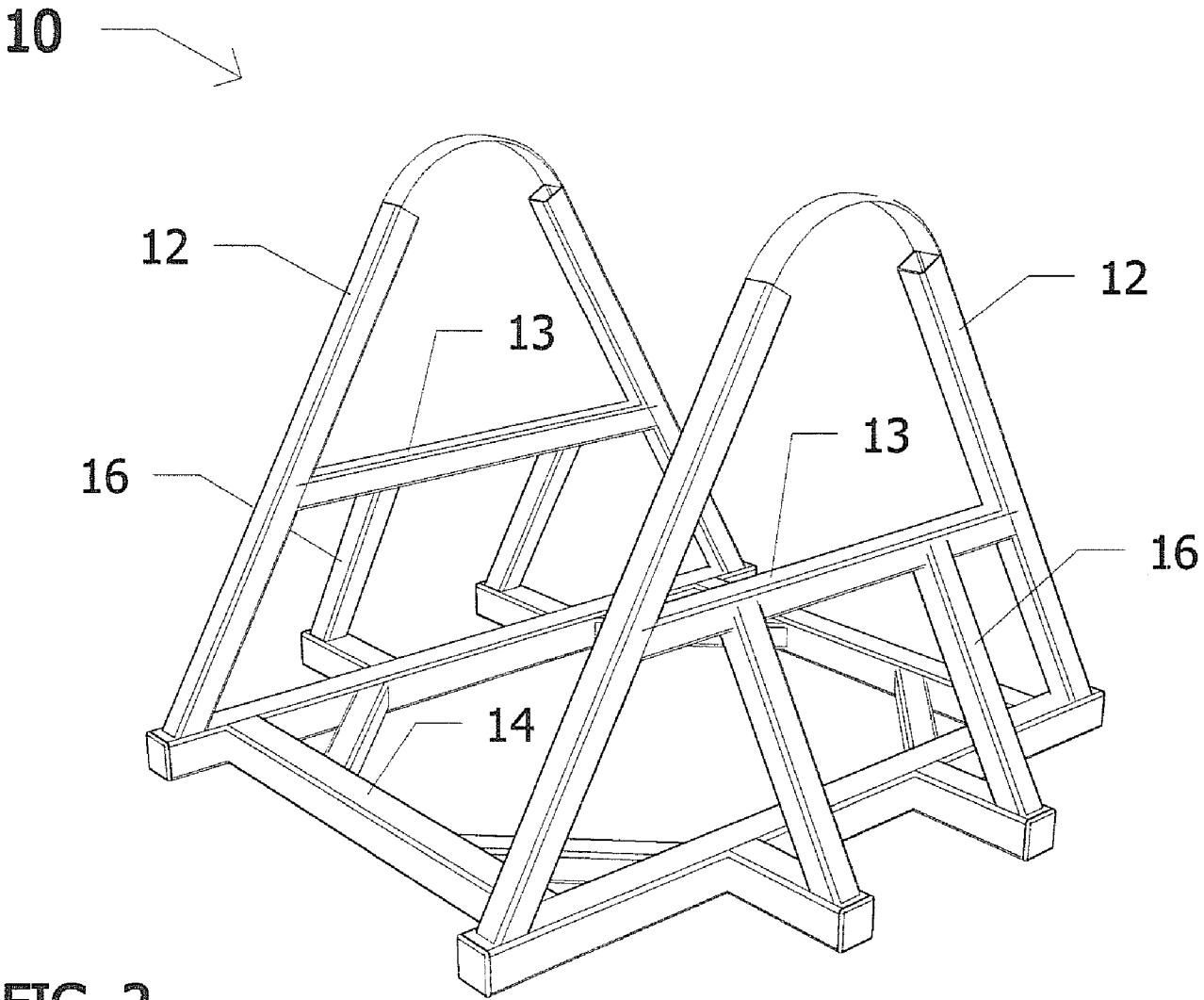
- FIG. 2 -

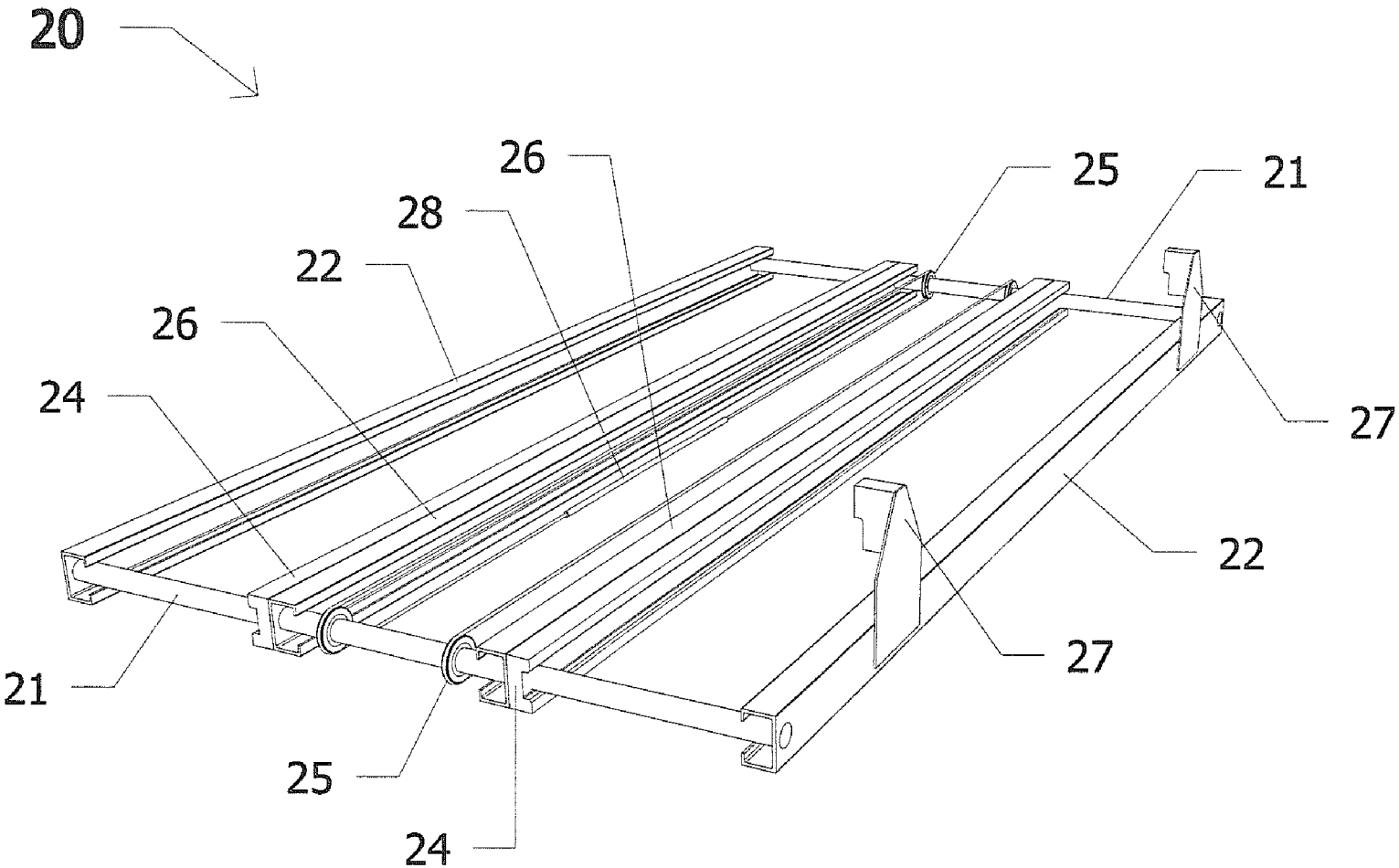
- FIG. 3 -

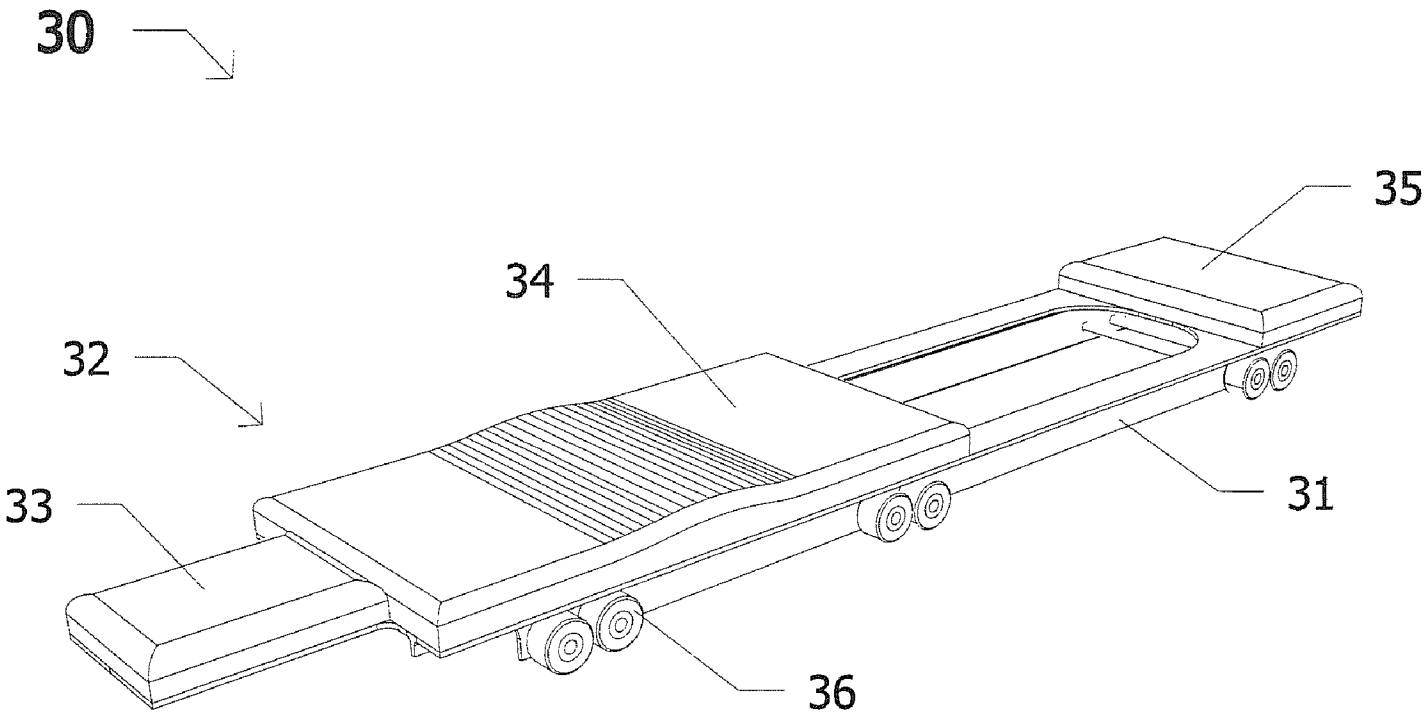
- FIG. 4A -

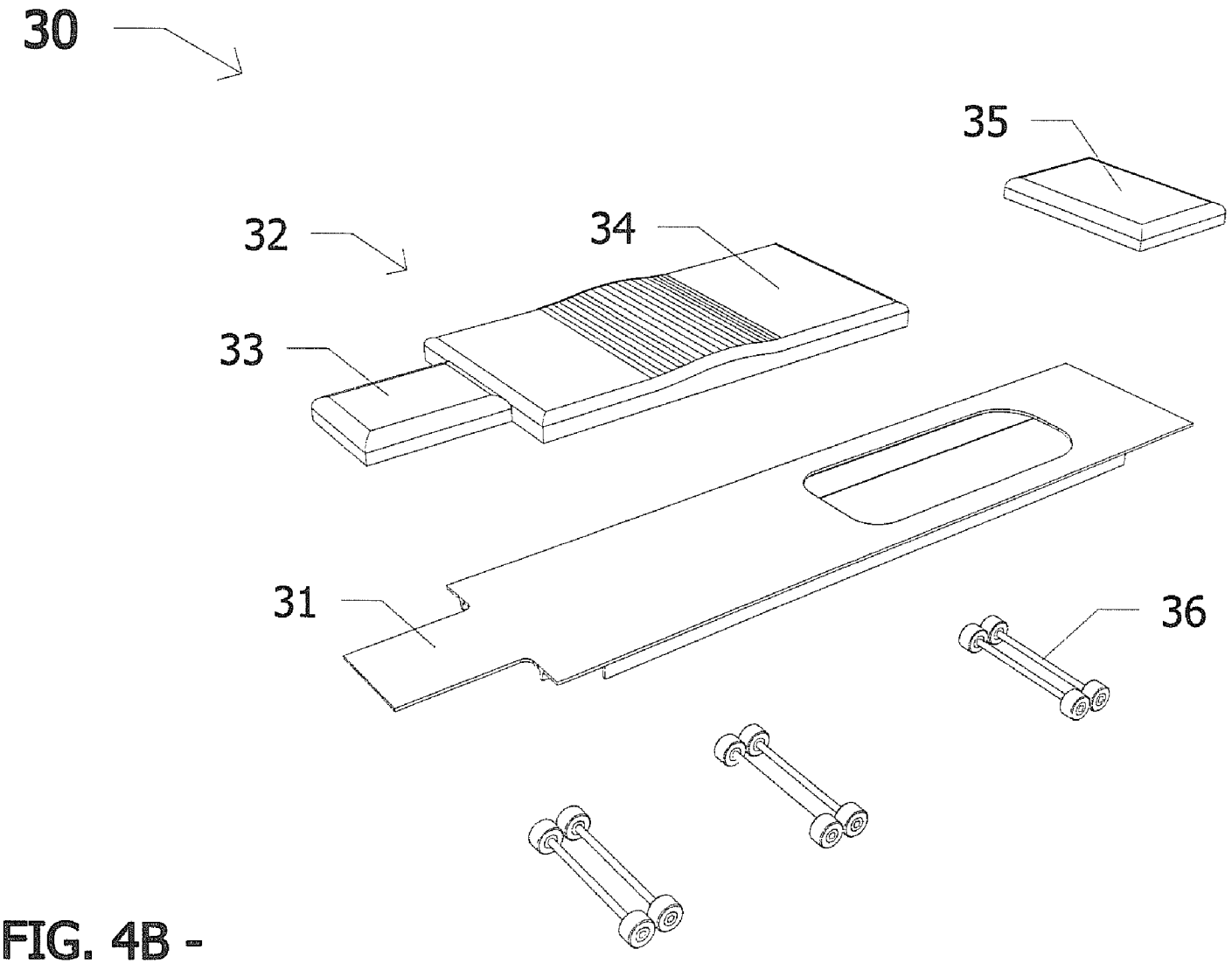
- FIG. 4B -

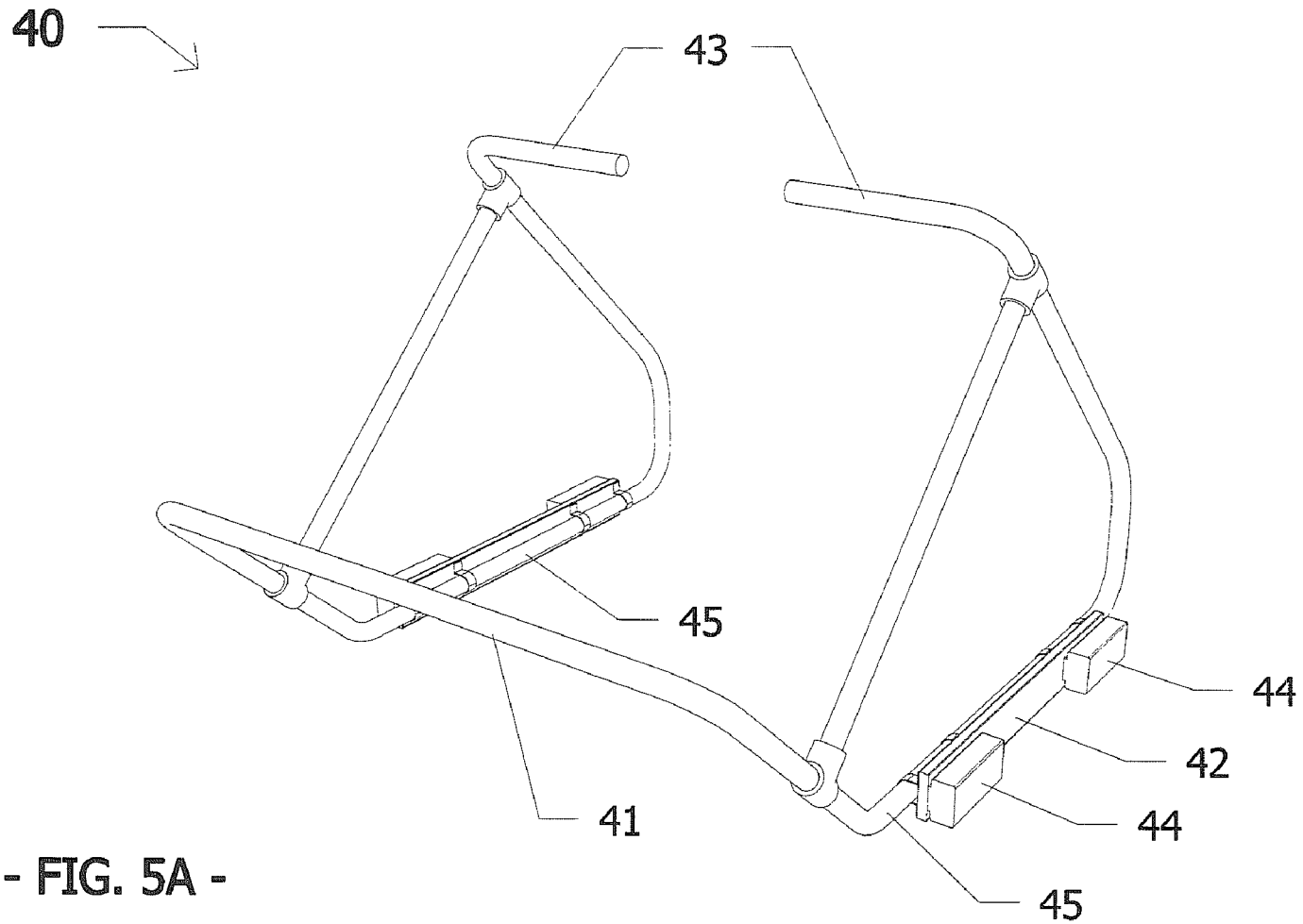
- FIG. 5A -

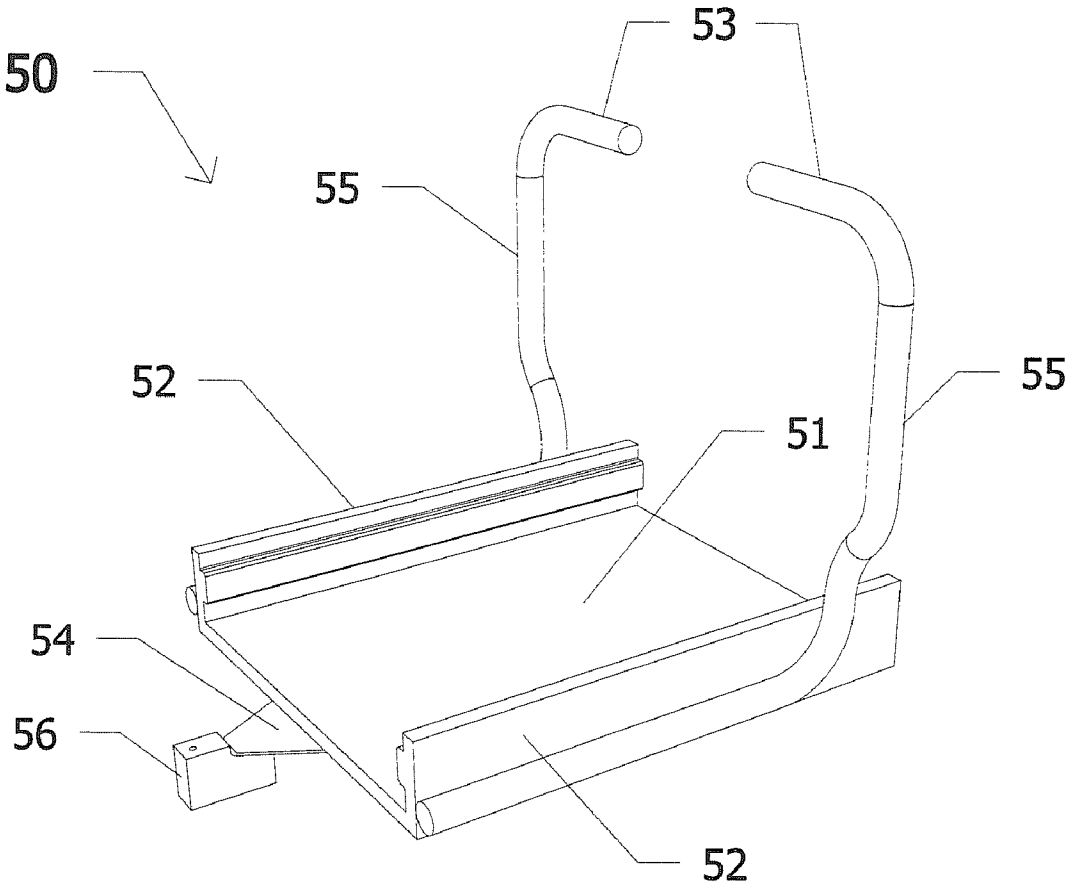
- FIG. 5B -

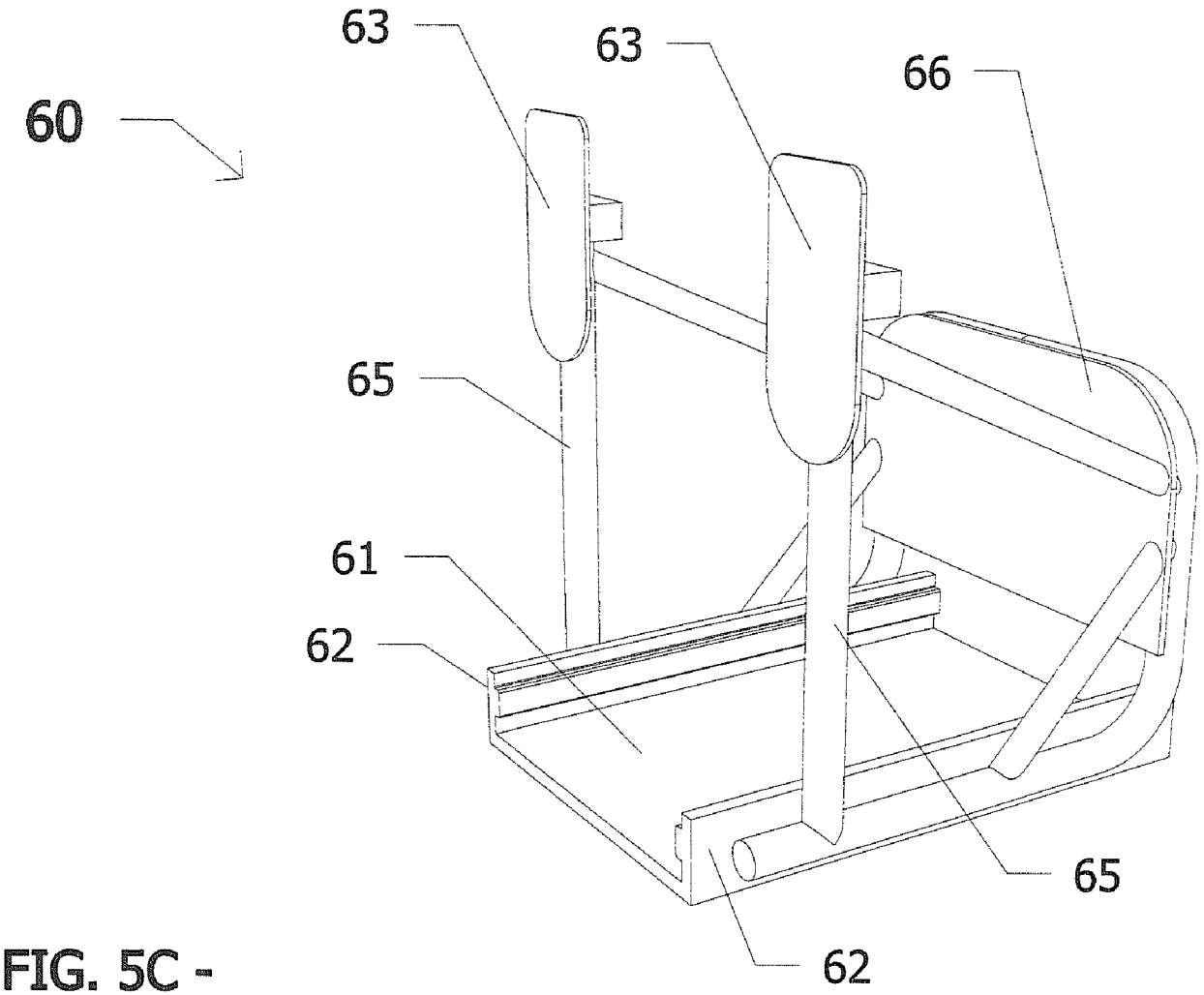
- FIG. 5C -

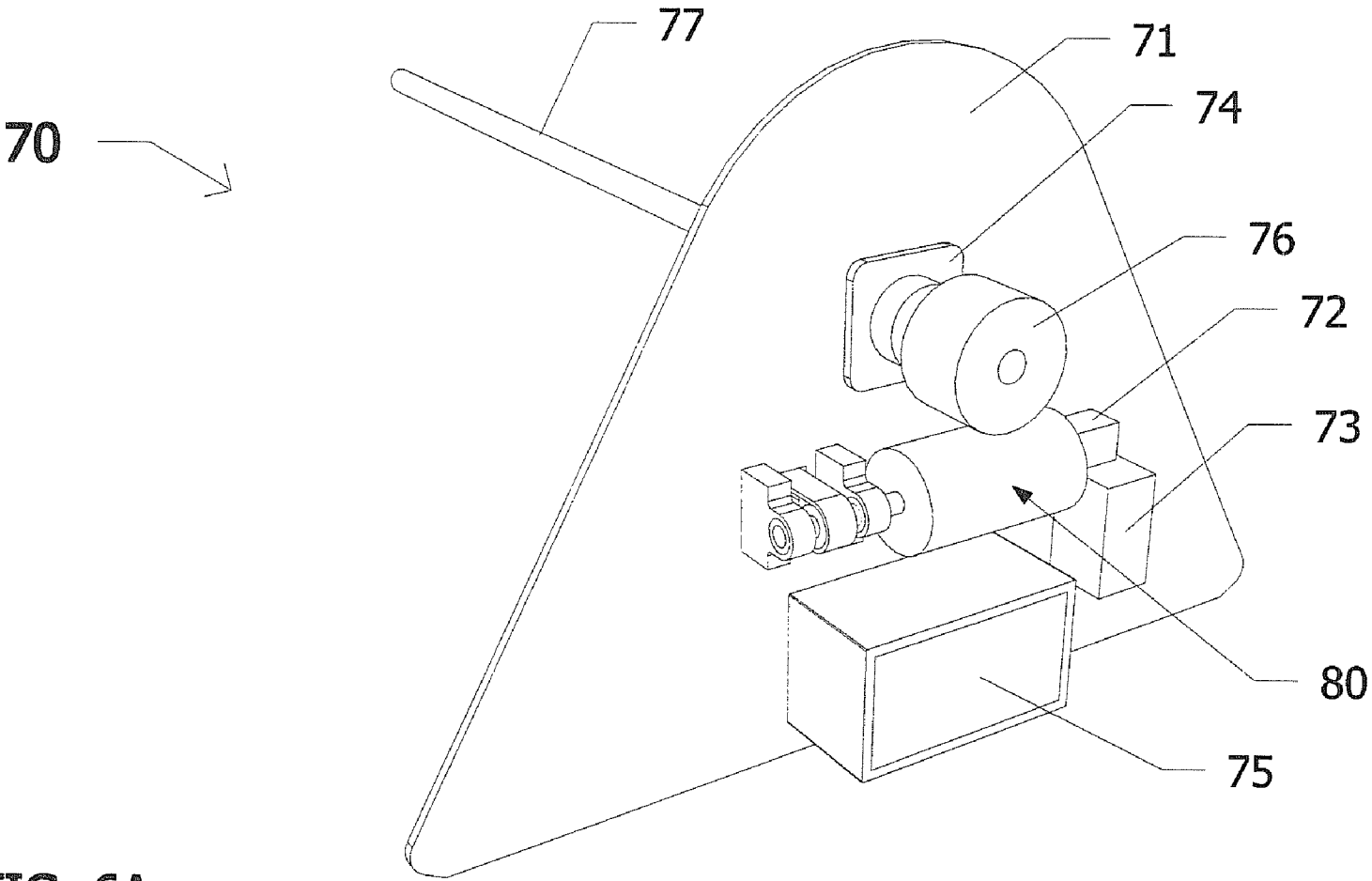
- FIG. 6A -

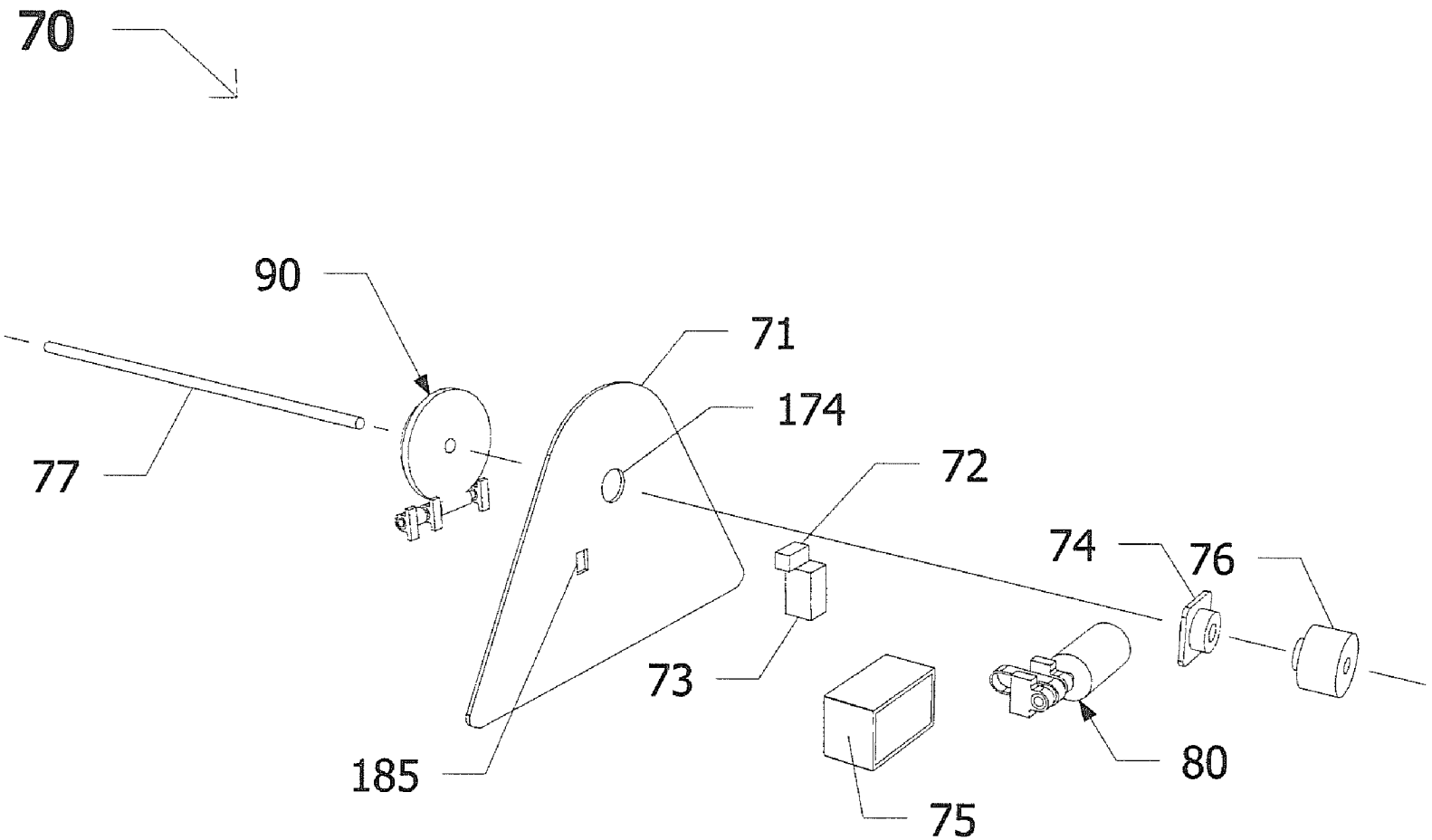
- FIG. 6B -

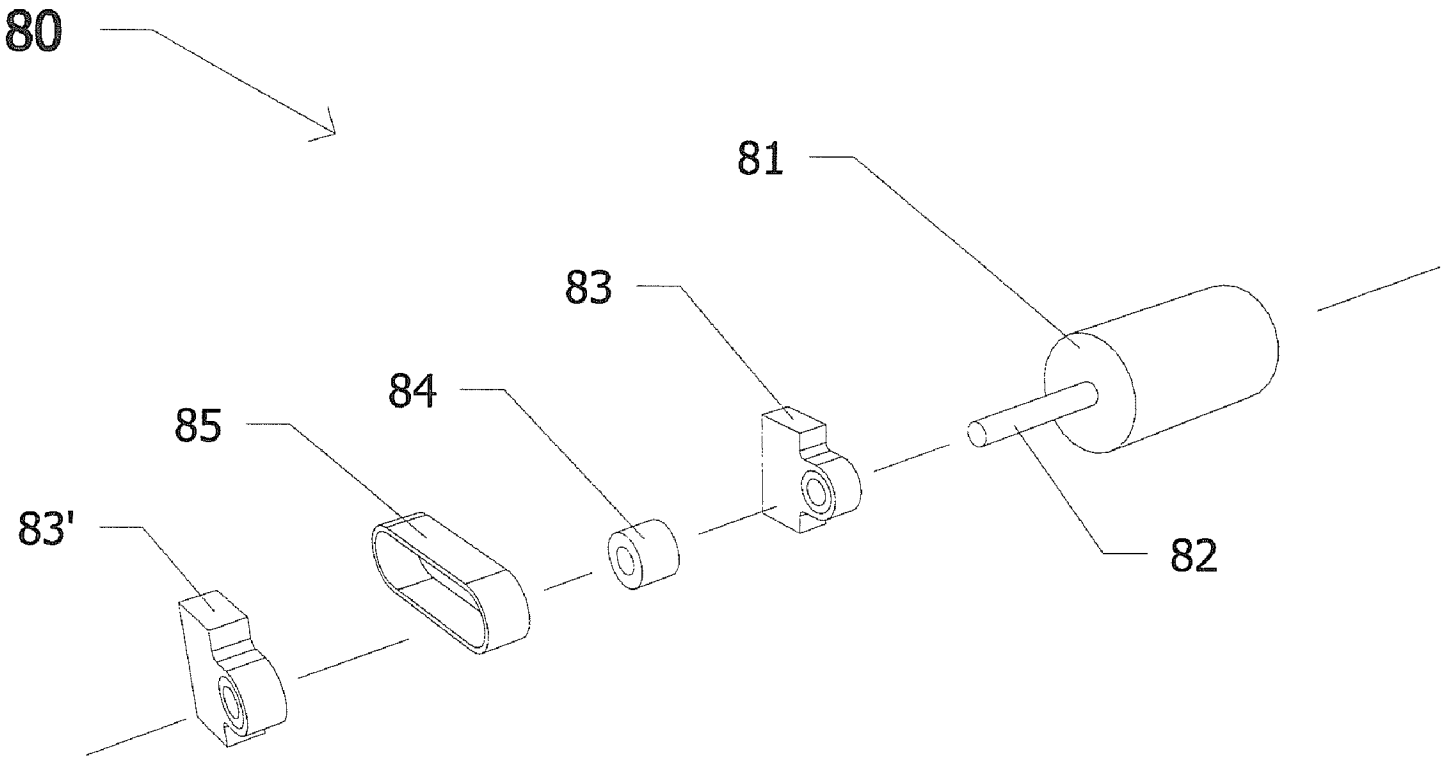
- FIG. 6C -

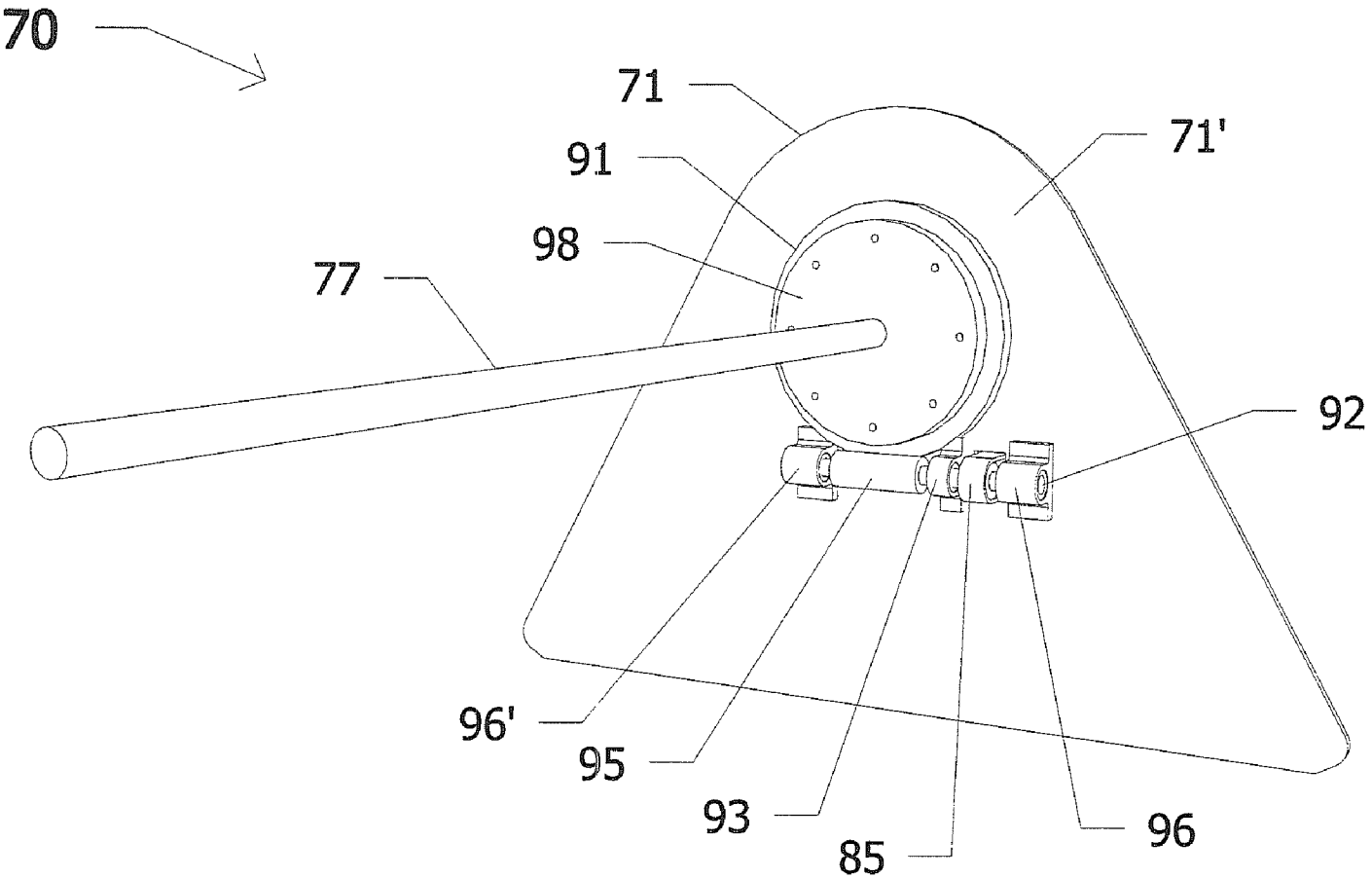
- FIG. 6D -

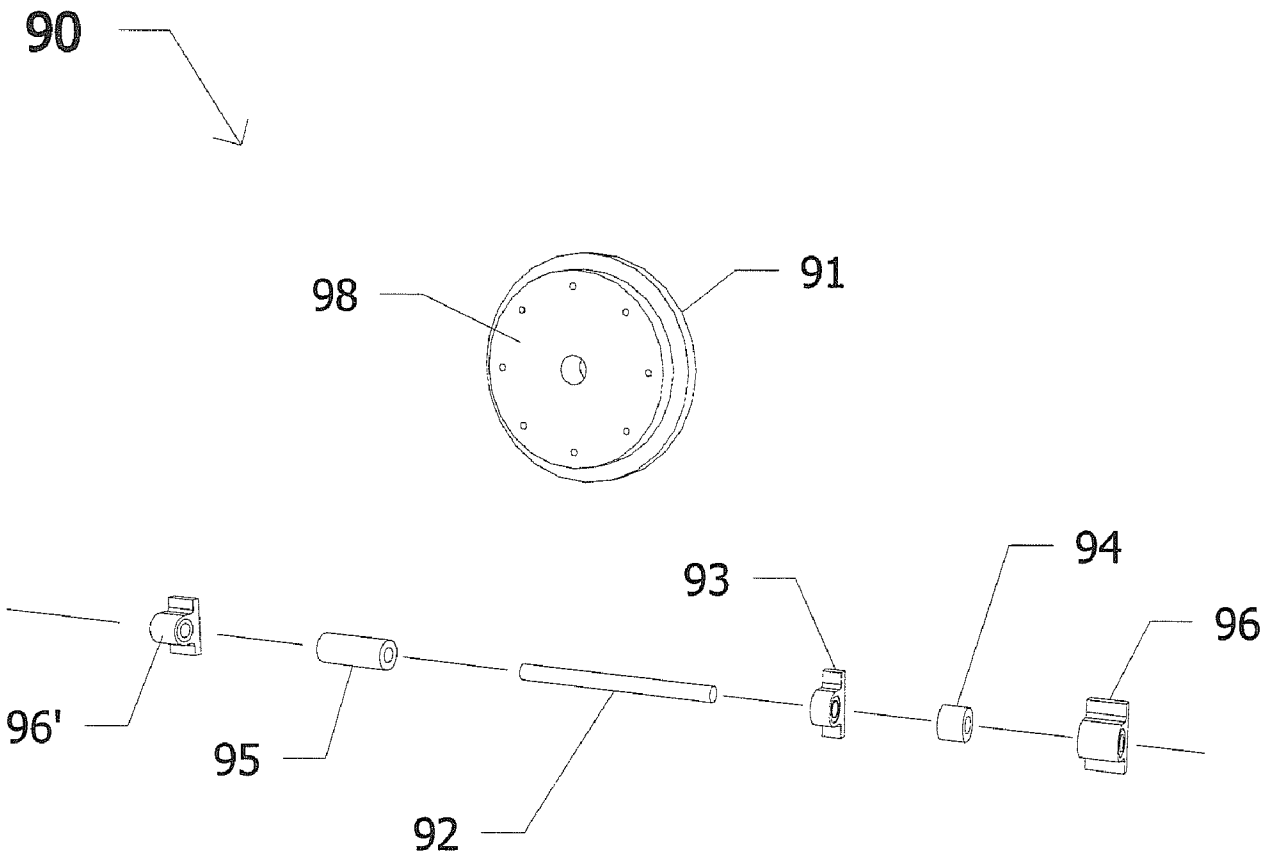
- FIG. 6E -

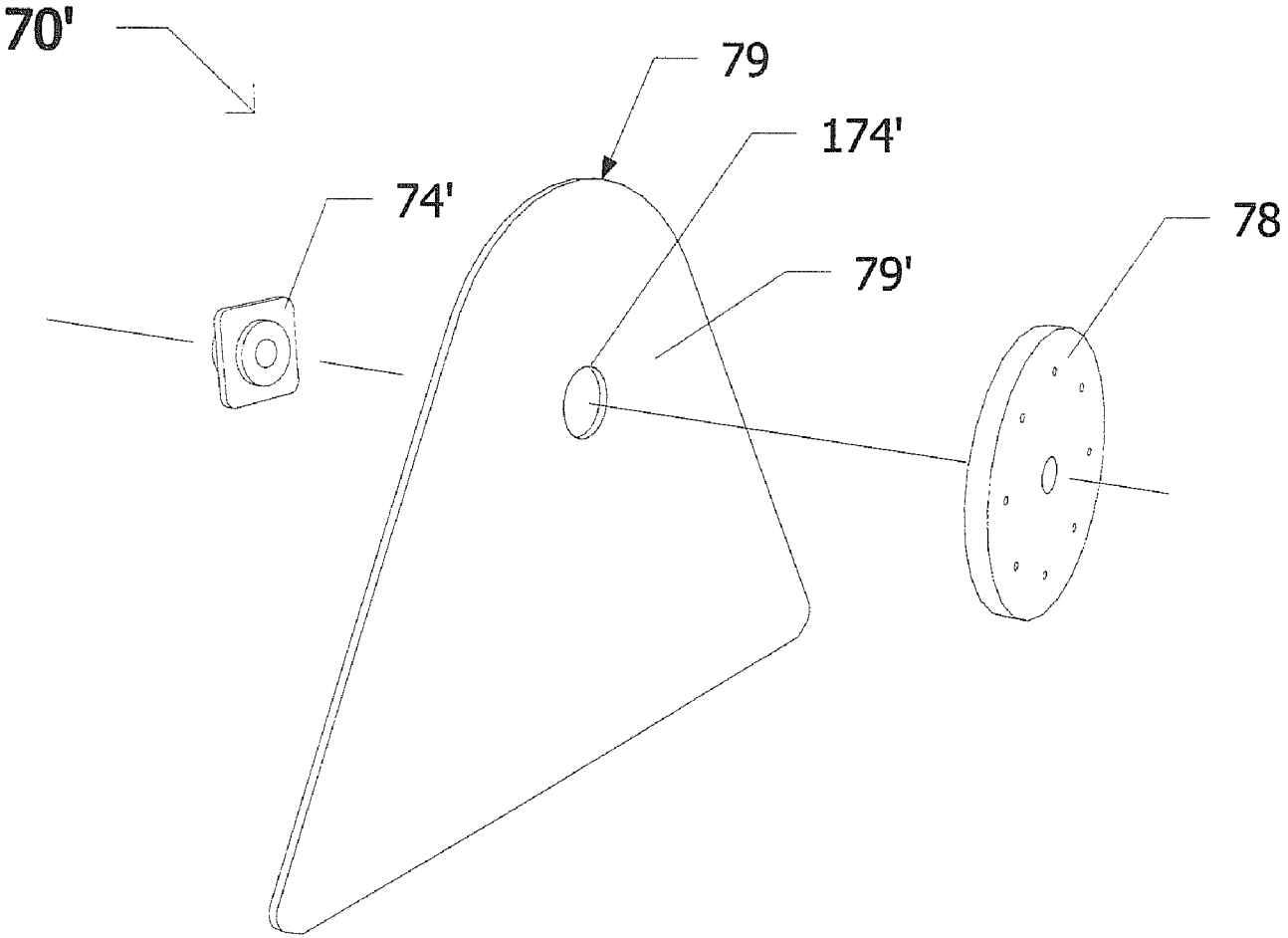
- FIG. 6F -

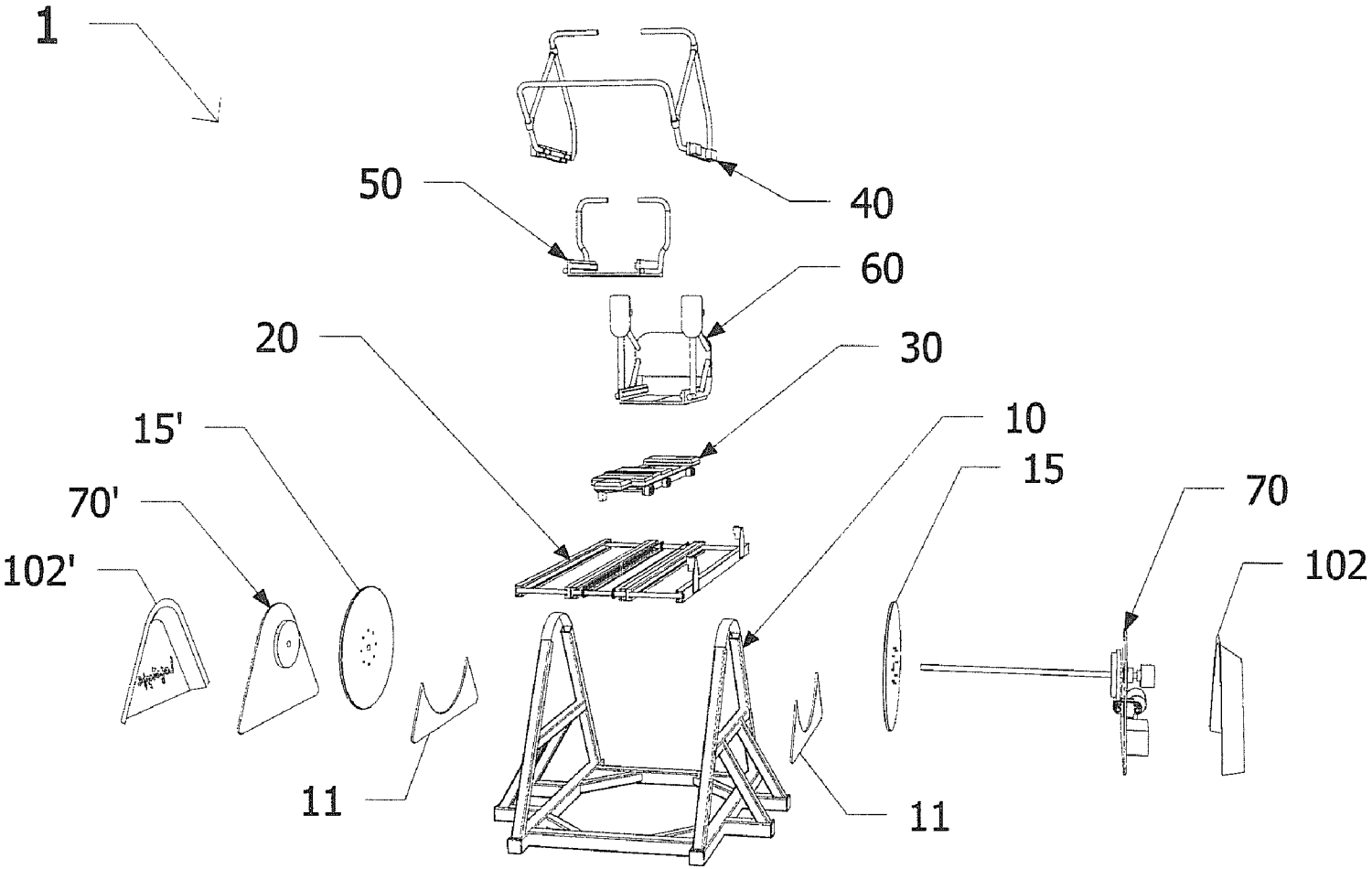
- FIG. 7 -

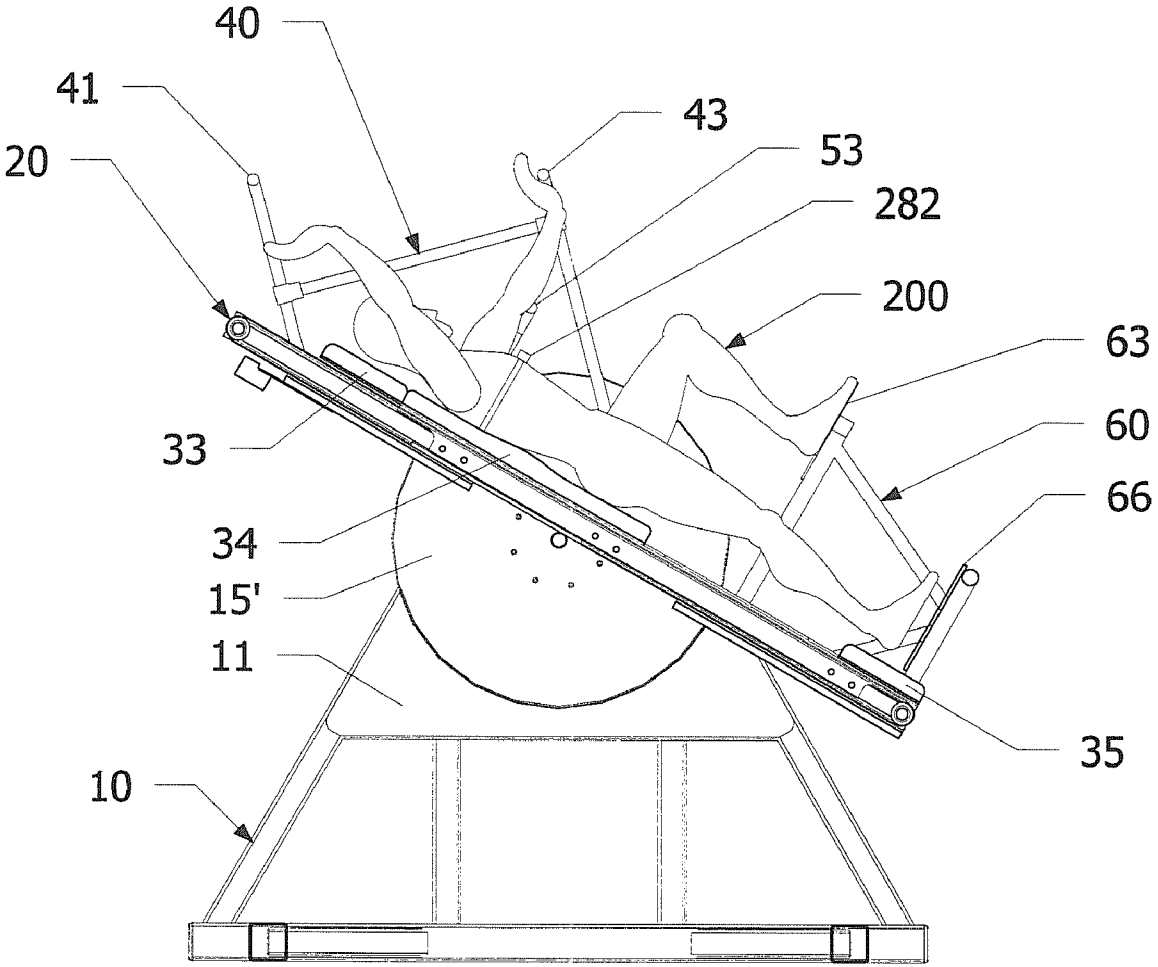
- FIG. 8 -

FITNESS MACHINE WITH AUTOMATED VARIABLE RESISTANCE

TECHNICAL FIELD

The present disclosure is directed to a fitness machine, which may provide both strength and cardio training by varying the angular orientation of the user to alter the amount of resistance experienced by the user. The fitness machine includes a rotatable bench rest assembly whose position may be automatically changed, as directed by a control system. The control system may be operated by manual control, programmable control, adaptive control, voice control, or combinations thereof.

BACKGROUND

There are several different types of exercise, including aerobic exercise and strength training. Many types of exercise are aerobic, which involve or improve oxygen consumption by the body. Generally performed at a moderate level of intensity over a relatively sustained period of time, aerobic exercises tend to strengthen and enlarge the heart muscle, thereby improving its pumping efficiency and reducing the resting heart rate; to strengthen the muscles involved in respiration, thereby facilitating the flow of air into and out of the lungs; to strengthen muscles throughout the body; to improve circulation and reduce blood pressure; to increase the total number of red blood cells in the body, thereby facilitating the transport of oxygen; and to improve mental health, including reducing stress and lowering the incidence of depression.

Many pieces of exercise equipment have been built for aerobic exercise, including stationary bicycles, stair-climbing machines, elliptical machines, and treadmills. While efficient for their intended purpose, these machines are generally limited to a single exercise (for example, walking), which may cause a user to become bored or muscle-fatigued over time. In addition, these machines are unable to be modified for strength training, as well as aerobic training.

Strength, or resistance, training is the use of resistance to muscular contraction to build the strength, anaerobic endurance, and size of skeletal muscles. There are many different methods of strength training, the most common being the use of gravity or elastic/hydraulic forces to oppose muscle contraction. Training commonly uses a variety of exercises and types of equipment to target specific muscle groups and often incrementally increases the amount of weight, elastic tension, or other resistance experienced to progressively increase muscle strength.

When properly performed, strength training exercises provide significant benefits to a person's health and well-being, including increasing bone, muscle, tendon, and ligament strength; improving joint function; increasing bone density; improving cardiac function; and reducing the potential for injury.

Equipment used for strength training includes weight boards, resistance bands, Swiss balls, and wobble boards. Some proponents of strength training have adapted it from being a primarily anaerobic exercise to an aerobic exercise through development of circuit training regimens.

What is needed in the industry is a piece of fitness equipment that may be used by persons of different heights, weights, and abilities for both aerobic and strength training. Further, what is needed is a piece of fitness equipment that includes controls for varying the resistance experienced by the user, either in response to a programmed series of instructions or to performance feedback acquired from the user.

SUMMARY

A fitness machine is provided herein, which includes a base frame having a pair of oppositely disposed vertical side members; a track assembly rotatably mounted to the base frame between the vertical side members; a drive assembly for rotating the track assembly relative to the base frame; a bench rest assembly slidably mounted to the track assembly for supporting a user in a supine position; a handle assembly and a footrest assembly fixedly attached to the track assembly; and a control system for directing the drive assembly to alter the angular orientation of the bench rest assembly to vary the resistance experienced by a user during an exercise routine.

According to one aspect, the base has a horizontal platform for contacting the floor and a pair of vertical side members projecting from opposite sides of the horizontal platform. Each of the vertical side members carries a track assembly support plate to which the track assembly is attached, thereby distributing the torque experienced by the track assembly.

The drive assembly uses driving components and driven components. The driving components, which include a direct current motor, a worm gear subassembly, and a main drive axle, are mounted to a first of the vertical side members of the base frame. The driven components, which include a mounting hub and an axle bearing, are mounted to a second of the vertical side members. The main drive axle extends from the first vertical side to the second vertical side.

The track assembly is rotatably mounted to the track assembly support plates on the vertical side members of the base frame. The track assembly itself may be rotated through a full 360 degrees. The track assembly possesses at least one interior pair of tracks and an exterior pair of tracks. The exterior tracks of the track assembly are C-shaped tracks, and the interior tracks of the track assembly are oppositely directed pairs of C-shaped tracks.

A slidable bench rest assembly is mounted within the interior tracks of the track assembly, using a plurality of off-set wheel assemblies. The bench rest assembly supports the user during his exercise routine. The bench rest assembly may include a number of attached cushions for supporting the user while exercising.

A handle assembly is fixedly attached to the exterior tracks of the track assembly. A second handle assembly, mounted to the interior tracks of the track assembly, may also be provided. The handle assemblies may assist the user in completing a number of different exercises.

A footrest assembly is fixedly attached to the outboard surfaces of the interior tracks or to an outward-facing set of interior tracks. The footrest assembly may include a primary footrest and a pair of auxiliary footrests.

A control system, which includes a rotary encoder and a processor, is operatively connected to the drive assembly. The rotary encoder provides the control system with positional information on the angular orientation of the bench rest assembly, and the control system providing signals to the drive assembly to alter the angular orientation of the bench rest assembly to vary resistance experienced by a user of the fitness machine.

The control system is operated in a mode selected from the group consisting of manual control, programmable control based on a predefined routine, adaptive control based on signals from the feedback mechanism, and voice-activated control. The control system may alter the angular orientation of the bench rest assembly repeatedly throughout an exercise session.

According to another aspect, the fitness machine may further include a feedback mechanism in operation with the control system. The feedback mechanism may be a plurality of photoelectric sensors, a heart rate monitor, or both a plurality of photoelectric sensors and a heart rate monitor.

The photoelectric sensors are attached to the exterior tracks of the track assembly at opposing ends thereof and are in communication with the control system, such that the control system alters the angular orientation of the bench rest assembly based on feedback from the photoelectric sensors. The photoelectric sensors provide a repetition time measurement.

The heart rate monitor may be attached to a belt, which is secured to the bench rest assembly and which is positioned about the chest of the user. The heart rate monitor is in communication with the control system, such that the control system alters the angular orientation of the bench rest assembly based on feedback from the heart rate monitor.

The fitness machine may also be provided with a counterweight pulley system. The pulley system supports the bench rest assembly and is attached to the track assembly between the interior tracks. The pulley system has a counterweight with a weight approximating the weight of the bench rest assembly to counterbalance the weight of the bench rest assembly.

BRIEF DESCRIPTION OF THE DRAWINGS

A full and detailed description of the present fitness machine is provided herein, with reference to the appended drawings, in which:

FIG. 1 is a perspective view of an assembled fitness machine, according to the present disclosure;

FIG. 2 is a perspective view of a base frame for the fitness machine of FIG. 1;

FIG. 3 is a perspective view of a track assembly for the fitness machine of FIG. 1;

FIG. 4A is a perspective view of a bench rest assembly for the fitness machine of FIG. 1;

FIG. 4B is an exploded view of the bench rest assembly of FIG. 4A;

FIG. 5A is a perspective view of a first handle assembly for the fitness machine of FIG. 1;

FIG. 5B is a perspective view of a second handle assembly for the fitness machine of FIG. 1;

FIG. 5C is a perspective view of a footrest assembly for the fitness machine of FIG. 1;

FIG. 6A is a perspective view of the driving components of a drive assembly for the fitness machine of FIG. 1, as seen from an outboard side of the fitness machine;

FIG. 6B is an exploded view of the driving components of the drive assembly of FIG. 6A;

FIG. 6C is an exploded view of a motor assembly used within the drive assembly of FIGS. 6A and 6B;

FIG. 6D is a perspective view of the driving components of the drive assembly of FIG. 6A, as seen from an inboard side of the fitness machine;

FIG. 6E is an exploded view of the driving components of the drive assembly shown in FIG. 6D;

FIG. 6F is an exploded view of the driven components of the drive assembly, as seen from an inboard side of the fitness machine opposite that side shown in FIG. 6D;

FIG. 7 is an exploded view of the fitness machine of FIG. 1; and

FIG. 8 is a side perspective view of the fitness machine of FIG. 1, in which a user is shown on the fitness machine.

DETAILED DESCRIPTION

The drawings and detailed description provide a full and detailed disclosure of the claimed subject matter, the manner and process of making and using various embodiments, and the best mode of carrying out the disclosure, to enable one skilled in the pertinent art to make and use the various embodiments. However, the examples set forth in the drawings and detailed description are provided by way of illustration only and are not meant as limitations of the disclosure. The present disclosure thus includes any modifications and variations of the following examples as fall within the scope of the appended claims and their equivalents.

FIG. 1 illustrates a fitness machine 1, in accordance with the teachings herein. Briefly, the fitness machine 1 includes a base frame 10, having oppositely disposed track support plates 15, 15' that support a track assembly 20. The track support plates 15, 15' and the track assembly 20 may be rotated, clockwise or counter-clockwise, to any position within a 360-degree range, to alter the resistance experienced by a user (200, as shown in FIG. 8) of the fitness machine 1.

The track assembly 20 further supports a bench rest assembly 30 on which the user (200) is positioned, the bench rest assembly 30 sliding within the track assembly 20 to permit the user (200) to perform a number of different exercises and to perform these exercises at varying levels of resistance. To that end, the fitness machine 1 may be equipped with a first handle assembly 40 (such as a pull-up/push-up bar) and/or a second handle assembly 50 (such as a dip/curl bar), as well as a footrest assembly 60. The drive mechanism for the fitness machine 1, which includes a user control panel 75 and a rotary encoder 76, is mostly hidden behind a cover 102. A number of photoelectric, or optical, sensors 27 are positioned strategically along the track assembly 20 to provide feedback to the drive mechanism.

The base frame 10, which is constructed of steel tubing or a similarly strong material, is shown in more detail in FIG. 2. The base frame 10 includes a horizontal platform 14 for contacting the floor and a pair of vertical A-shaped side members 12 projecting from opposite sides of the horizontal platform 14. Each of the vertical side members 12 has a horizontal cross-bar 13. The cross-bars 13 and the vertical side members 12 support a pair of oppositely disposed inboard cover plates 11 and a pair of track support plates 15, 15', as shown in FIGS. 1 and 7. The cross-bars 13 are further reinforced, on each side, by a pair of angular support braces 16. Although two support braces 16 are shown on each side, a different number of braces 16 may be instead be used, as needs dictate.

FIG. 3 illustrates the track assembly 20 that supports the bench rest assembly 30. The track assembly 20 has a generally rectangular profile, with a width approximating the interior distance between the two vertical side members 12 of the base frame 10 and a length that is greater than its width. The track assembly 20 has a pair of transverse track frame support bars 21 and a number of longitudinal, parallel tracks 22, 24, 26 having a generally C-shaped cross-sectional profile.

The exterior tracks 22, along with the support bars 21, form the perimeter of the track assembly 20. Set screws 23, or other fasteners, are used to secure the support bars 21 to the exterior tracks 22. The mounting plates 27 for the optical sensors and the handle assembly 40 (shown in more detail in FIG. 5A) are both attached to the exterior tracks 22, with the mounting plates 27 being attached to the outboard surfaces of the exterior tracks 22 and the handle assembly 40 being held within and attached to the inboard surfaces of the exterior tracks 22. The mounting plates 27 are positionally adjustable along the length of the exterior tracks 22 to accommodate users of different heights.

The outboard-facing interior tracks 24 are positioned in abutting, oppositely directed relationship with the inboard-facing interior tracks 26. As shown, the outboard-facing interior tracks 24 have a greater cross-sectional thickness than the adjacent inboard-facing interior tracks 26, to provide greater support for the attached dip/curl bar assembly 50 and the footrest assembly 60. Although illustrated as separate C-shaped tracks, a single I-shaped track could be used instead of the interior tracks 24, 26.

The inboard-facing interior tracks 26 support the bench rest assembly 30. Unlike the handle assembly 40, the dip/curl bar assembly 50, and the footrest assembly 60, which are all stationary relative to the track assembly 20, the bench rest assembly 30 is mounted within the interior tracks 26 so that the bench rest assembly 30 may slide linearly along the tracks 26. The specific construction of the bench rest assembly 30 is shown in more detail in FIGS. 4A and 4B. A pair of counterweight pulley assemblies 25, which are positioned between the interior tracks 26, include weights 28 approximating the weight of the bench rest assembly 30. Thus, the counterweight pulleys 25 serve to neutralize, or counterbalance, the effects of the weight of the bench rest assembly 30 on the resistance experienced by the user (200). A single pulley assembly 25 with a counterweight 28 may be employed in lieu of the two pulley assemblies shown in FIG. 3, if so desired.

The aforementioned bench rest assembly 30 is shown in greater detail in FIGS. 4A and 4B. The bench rest assembly 30 includes a bench rest assembly support frame 31 and a number of bench rest assembly pads 32 attached to the upper surface of the bench rest assembly support frame 31. The bench rest assembly pads 32 include a head rest 33 and a back support cushion 34, which support a user (200) of the fitness machine 1 in a generally supine position with the back of the user 1 being in contact with the back support cushion 34. A leg support cushion 35 is secured to the support frame 31 at an opposite end from the head rest 33.

The bench rest assembly 30 may further include a safety belt (not shown) that is affixed to the bench rest assembly 30 beneath the back support cushion 34, such that the safety belt wraps around the mid-section of the user 200 to harness the user 200 when inverted or partially inverted. The safety belt may also be provided with a spring-loaded interlocking mechanism that engages one or both cables of the counterweight pulleys 25. When the user 200 intends to be inverted or partially inverted and fastens the safety belt, the interlocking mechanism disengages the cable(s) of the pulleys 25 and the bench rest assembly 30 is free to slide within the interior tracks 26. Alternately, when performing exercises that are more easily accomplished with the bench rest assembly 30 in a fixed position, the user 200 may release the safety belt, causing the spring-loaded interlocks to engage the cable(s) of the pulleys 25 and to thereby prevent movement of the bench rest assembly 30.

The bench rest assembly support frame 31 further includes several track wheel subassemblies 36, which are arranged in pairs along the length of the support frame 31. Each track wheel subassembly 36 has a central axle positioned between two wheels, which may be made of a hard urethane, a hard nylon, or a thermoset polymer. Within each pair, the central axles of the wheel subassemblies 36 are off-set from one another, that is, are located on different planes. Thus, as the bench rest assembly 30 is rotated to various angles, contact is maintained between the interior tracks 26 and the wheels of the wheel subassemblies 36.

FIGS. 5A, 5B, and 5C illustrate different attachments for the fitness machine 1. FIG. 5A shows a handle assembly 40 having multiple grip positions, while FIG. 5B illustrates a second handle assembly 50 having alternate grip positions. FIG. 5C shows a representative footrest assembly 60.

The handle assembly 40 (of FIG. 5A) includes a centrally located horizontal bar 41 that, when installed, is transverse to the track assembly 20 and a pair of handle grips 43 that extend over the bench rest assembly 30 in a transverse direction. The horizontal grip bar 41 is angularly offset from a pair of parallel arms 45, to each of which are attached a handle assembly guide 42 and a pair of guide blocks 44. The handle assembly guide 42 and the guide blocks 44 are configured to fit within the channels of the exterior tracks 22 of the track assembly 20. The handle assembly 40 is secured in a stationary position within the exterior tracks 22 by a fastener (not shown), such as a depressible spring-loaded pin located within the bottom of each guide block 44 that extends through correspondingly sized holes in the bottom of the exterior tracks 22. Alternate attachment means (such as bolts and nuts) could instead be used. Further, a number of spaced holes may be provided in the bottom of the exterior tracks 22, so that the handle assembly 40 may be positioned appropriately for users of different heights.

A second handle assembly 50 is shown in FIG. 5B. The handle assembly 50, also referred to herein as the dip/curl bar, includes a planar bottom surface 51, a pair of upright side panels 52 that are perpendicular to the bottom surface 51, and a pair of vertically extending arms 55 from which the handle grips 53 extend inwardly over the bottom surface 51. The side panels 52 function as guides for the handle assembly 50 and are configured to fit within the channels of the outboard-facing interior tracks 24 of the track assembly 20 (as shown in FIG. 1). The handle assembly 50 is secured in a stationary position within the interior tracks 24 using the same depressible spring-loaded pin attachment mechanism described with reference to the handle assembly 40.

The handle assembly 50 is provided with a bracket 54 to which a photoelectric sensor 56 is mounted. The bracket 54 extends from the central portion of the bottom surface 51 of the handle assembly 50 on the side opposite the handle grips 53. The sensor 56 provides information on the position of the user (200) to the motor control 73 and the user control panel 75, during certain exercises (such as dips).

The footrest assembly 60, shown in FIG. 5C, includes a planar bottom surface 61, a pair of upright side panels 62 that are perpendicular to the bottom surface 61, a pair of vertically extending arms 65 to which the auxiliary foot platforms 63 are attached, and a primary foot platform 66. The primary foot platform 66 and the auxiliary foot platforms 63 are each oriented perpendicularly to the plane of the bottom surface 61 and in parallel planes to each other. The primary foot platform 66 provides a convenient surface onto which the user may step (or stand) when mounting (or dismounting) the fitness machine 1. The primary foot platform 66 may also include a cap (not shown) at the upper edge thereof (i.e., distal to the bottom surface 61) to hold the toes of the user when the bench rest assembly 30 is inverted or at a steep angled position. Alternately, other methods of securing the feet of the user, such as a safety belt, may instead be employed. The footrest assembly 60 is also attached to the interior tracks 24, opposite the handle assembly 50, using the same depressible spring-loaded pin attachment mechanism describe with reference to the handle assembly 40.

FIGS. 6A through 6F illustrate various components of the drive assembly mechanism 70. For ease of discussion, the side of the fitness machine 1 to which the motor 80 is connected will be referred to as the "driving side", whereas the opposite side of the fitness machine 1 will be referred to as the "driven side." FIGS. 6A through 6E show various views of the driving side of the fitness machine 1, whereas FIG. 6F shows the driven side of the fitness machine 1.

The outboard surface of the driving side of the drive assembly 70 is shown in FIGS. 6A and 6B. A drive assembly support plate 71 has dimensions approximating those of the upper portion of the vertical side members 12 of the base frame 10, that is, the triangular section about the cross-bars 13, and is attached thereto either by welding or with bolts. The drive assembly support plate 71 provides an attachment surface for the driving components of the drive assembly 70. (An identical plate 79 is provided on the driven side of the fitness machine 1 for supporting the driven components, as shown in FIG. 6F.) A bearing opening 174 and a belt opening 185, as will be discussed below, are provided through the drive assembly support plate 71.

As shown in FIGS. 6A and 6B, a main drive axle 77 extends through a gear assembly 90 and a main axle bearing 74 on the driving side, terminating in a coupling to a rotary encoder 76. The rotary encoder 76 senses the rotational position of the main drive axle 77 and converts the information to an analog or digital code that is conveyed (by wiring, not shown) to a motor control 73. On the driven side (visible in FIG. 6F), the main drive axle 77 extends through a mounting hub 78 on the second drive assembly support plate 79 and terminates in a second main axle bearing 74' located in a bearing opening 174' in a second drive assembly support plate 79. In this manner, the main drive axle 77 extends across the width of the base frame 10 beneath the track assembly 20.

A silicon-controlled rectifier 72 is provided to convert alternating current voltage (for example, 110 volt NC) from an electrical outlet into a direct current voltage appropriate for the servomotor 81 (as shown in FIG. 6C). In one aspect, the rectifier 72 provides 90 volts of direct current to the servomotor 81, which allows variable speed and reversible polarity. The rectifier 72 works in conjunction with the motor control 73, which will be discussed below. The user control panel 75, which may be in the form of a touch pad or a touch pad display, includes a programmable logic controller (PLC) that allows the user (200) to operate the fitness machine 1 in various modes, as will be further discussed herein. The user control panel 75 may be provided with a display area for exhibiting the settings of the machine 1 or the performance data of the user (200). Information on the display may be transferred wirelessly or through a key card for printing, if desired. Alternately, or additionally, the user control panel 75 may be provided with a speaker (not shown), which generates an electronic voice in response to user commands or user performance. By way of example, the electronic voice may provide a count of repetitions performed or a count-down of repetitions to be performed.

The motor assembly 80 is a closed-loop control system with three control loops: the position loop, the velocity loop, and the current loop. In operation, a tachometer (not shown) is coupled with the servomotor 81 to sense the motor speed and to convey the signal through the velocity loop to the motor control 73. The rotary encoder 76, which is coupled with the main drive axle 77, senses the position of the main axle 77 (and, therefore, the corresponding track assembly 20 and attached bench rest assembly 30) and conveys an appropriate signal to the motor control 73. The motor control 73 continuously processes, or "sums", the speed and position signal inputs, along with the current (fed back through the current loop) and compares the "sum" with the desired values set by the control program of the user control panel 75. The motor control 73 then generates a signal to control the speed and directional rotation of the motor shaft 82 (shown in FIG. 6C).

Specifically referring now to FIG. 6C, the servomotor 81 of the motor assembly 80 transmits rotational motion to the motor shaft 82. The motor shaft 82 is supported radially by two pillow block bearings 83, 83', which are located on each side of a driving belt sheave 84. The driving belt sheave 84 is keyed to the motor shaft 82 and transfers, via a drive belt 85, rotational movement from the motor shaft 82 to a corresponding driven belt sheave 94 (seen most clearly in FIG. 6E) on the opposite (inboard) surface of the drive assembly support plate 71.

FIGS. 6D and 6E illustrate the worm gear assembly 90, which operates in conjunction with the motor assembly 80, to form a complete drive assembly 70. The driven belt sheave 94, which receives rotational movement from the driving belt sheave 84 via the drive belt 85, is keyed to a worm shaft 92. The worm shaft 92 is likewise keyed to a worm 95, which transfers rotational movement to a worm gear 91 with a high mechanical advantage. The worm gear 91 is mounted on an inboard surface 71' of the drive support plate 71, such that the main drive axle 77 extends through the worm gear 91 and into the main axle bearing 74 (as shown in FIG. 6A). The worm gear 91 is keyed to the main drive axle 77, so that movement is transferred from the worm gear 91 to the main drive axle 77. At the opposite end of the main drive axle 77, the main drive axle 77 is also keyed to a mounting hub 78 on the driven side of the fitness machine 1.

The gear assembly 90 is seen most clearly in FIG. 6E. The worm shaft 92 is keyed to and is positioned through the worm 95. A pillow block bearing 96, 96', which is a combination radial/thrust bearing, is positioned at each end of the worm shaft 92 to support the worm shaft 92 and to bear any axial forces imparted to the worm 95 and the worm shaft 92 by the worm gear 91 when the fitness machine 1 is in use. A standard pillow block bearing 93 is positioned between the worm 95 and the driven belt sheave 94. An oil reservoir (not shown) may be located beneath the worm 95 for lubrication purposes.

The mounting hub 98 is attached to the front, or inboard side, of the worm gear 91. From this position, the mounting hub 98 may also be connected to the track frame support plate 15 (as seen in FIG. 7). The rotation of the worm 95 and the worm gear 91 causes the mounting hub 98 to rotate, thus resulting in the movement of the track frame support plate 15 and the track frame 20 that is attached to the opposite side of the support plate 15.

FIG. 6F illustrates the driven components 70' of the drive assembly 70, as seen from the inboard surface 79' of the driven side support plate 79. The driven side support plate 79 includes a bearing opening 174' therethrough for receipt of a main axle bearing 74'. The main axle bearing 74' is positioned on the outboard surface of the driven side support plate 79 and extends inwardly through the bearing opening 174' for engagement with the main drive axle 77 (not shown in this view). The mounting hub 78 is secured to the inboard side of the driven side support plate 79 and to the outboard side of the track frame support plate 15'.

The various components and their relative placement are shown in FIG. 7, which is an exploded view of the fitness machine 1. The base frame 10 supports all of the other components. A pair of cover plates 11 are attached to the inboard surfaces of the horizontal cross-bars (13) of the base frame 10. The track frame support plates 15, 15' are positioned inboard of the vertical side members (12) of the base frame 10 along the main drive axle (77) of the drive assembly 70. The driving side track frame support plate 15 is mounted to both the worm gear (91) of the drive assembly 70 and to the driving side exterior frame (22) of the track assembly 20.

Similarly, the driven side track frame support plate 15' is mounted to both the mounting hub (78) of the drive assembly 70' and to the driven side exterior frame (22) of the track assembly. By attaching both the drive components and the track assembly components to the track frame support plates 15, 15', the track frame support plates 15, 15' move in conjunction with the track assembly 20 in response to the drive assembly 20, thereby dissipating the amount of torque experienced by the track assembly 20 and the main drive axle (77) and providing greater stability to the track assembly 20.

The drive assemblies 70, 70' on the driving and driven sides, respectively, are housed beneath outboard cover plates 102, 102'. The cover plate 102 on the driving side may include at least one opening therethrough for access to the user control panel (75). The cover plates 102, 102' may also include instruction and/or warning labels, as well as the trade name of the fitness machine 1 and/or its manufacturer.

The track assembly 20 is positioned between the vertical side members (12) of the base frame and is bolted or otherwise secured to the track frame support plates 15, 15'. The track assembly 20 includes multiple sets of tracks 22, 24, 26, as shown in FIG. 3, within which the bench rest assembly 30, the handle assemblies 40, 50, and the footrest assembly 60 are located. As mentioned previously, the handle assemblies 40, 50, and the footrest assembly 60 are each stationary relative to the track assembly 20, whereas the bench rest assembly 30 is permitted to move along the length of the interior tracks (26).

The handle assemblies 40, 50 and the footrest assembly 60 are used in various exercises that may be performed on the fitness machine 1. As shown in FIG. 8, a user 200 lies supine on the bench rest assembly 30 with his head positioned on the head rest cushion 33, his back supported by the back rest cushion 34, and his feet resting on the leg support cushion 35. In this illustration showing different positions for the user's appendages, the right hand is extended above the user's head as if to grasp the handlebar 41, the left hand is extended upwardly from the shoulder to grasp the handle grip 43, the left leg is extended so that the user's foot is resting on the primary foot platform 66, and the right leg is bent at the knee so that the user's foot is in contact with the auxiliary foot platform 63. The handle grips 53 of the dip/curl bar (50) are not being used in this exemplary representation.

The handlebar 41 may be used to perform exercises, such as pull-ups, in which the user 200 may use his arm strength to slide the bench rest assembly 30 up and down within the track assembly 20. The handle grips 43 may be used to perform push-ups. The handle grips 53 may be used to perform abdominal curls and dips. The primary foot platform 66 may be used as a resting position when the user 200 performs calf raises, knee lifts, and leg lifts. The auxiliary foot platforms 63 are useful when the user 200 is performing squats. The user 200 may also use the bench rest assembly 30 itself as a support for performing sit-ups or crunches. Any of these exercises may advantageously be performed in a "normal" position or in an downwardly inclined or inverted position to increase the amount of resistance experienced by the user 200. As mentioned previously, the user 200 wears a safety belt (not shown) around his waist and inserts his toes into a cap or ledge (not shown) on the primary foot platform 66, when preparing to perform exercises in an inclined or inverted position.

There are several modes of operation of the fitness machine 1 described herein, including manual control, programmable control based on a predefined routine, adaptive control based on signals from a feedback mechanism, and voice-activated control. Typically, the track assembly 20 and corresponding bench rest assembly 30 are oriented in an upright ("home") position, with the footrest assembly 60 proximate the floor and the head rest cushion 33 positioned toward the ceiling. A user 200 determines which mode of operation he wishes to use and sets the user control 75 accordingly. Then, the user 200 mounts the fitness machine 1 by stepping onto the primary footrest 66 and secures himself by attaching a safety belt (not shown) around his waist. Based on the program associated with the control mode, the machine 1 rotates the user 200 to a first position to begin his exercise routine.

In the manual control mode, the user 200 mounts the machine 1 and begins to exercise, according to his own rate and his desired angular orientation. The user 200 may set the user control 75 to a certain angle (for example, inclined head-down at an angle of five degrees from horizontal) before beginning his exercise routine. During the exercise routine, the user 200 may use voice-activated controls to adjust the angular orientation of the bench rest assembly 30. By way of example, and not limitation, the user 200 may say the words "up" or "down" to change the degree of incline of the bench rest assembly 30 by a pre-set amount, such as five degrees. The manual control mode may be beneficial when the user 200 lacks sufficient time to complete an entire exercise routine or when the user 200 wishes to perform exercises that target a specific muscle group.

In the programmable control mode, the user 200 selects a desired routine (for instance, from a pre-programmed catalog of routines, time periods, and difficulties) from the PLC of the user control 75. The user 200 then performs a series of exercises with the machine 1 automatically rotating the bench rest assembly 30 to different angular orientations, as specified by the selected program. Because the programmable control mode relies upon pre-defined routines and not user feedback, the motor control 73 makes no measurement of, or accommodation for, the user's repetition time or heart rate, as is possible with the adaptive control mode yet to be described. When the user reaches the end of the series of routines, the bench rest assembly 30 is returned to its "home" (or upright) position to allow the user 200 to dismount the machine 1. It should be noted that the user 200 may also return the bench rest assembly 30 to the home position by voice command (for instance, by saying the word "home") at any time during the routine.

In the adaptive control mode, the machine 1 includes at least one type of feedback mechanism. The feedback mechanism may be in the form of a plurality of optical sensors (27, 56) that are located at various locations along the track assembly 20. Alternately, or in addition, the feedback mechanism may be in the form of a heart rate monitor (282, shown in FIG. 8) that is located along a strap or belt that encircles the chest of the user 200 during the exercise routine. Alternately, the heart rate monitor 282 may be incorporated as a finger-mounted clip that attaches to the user's index finger during exercise. Yet another alternative is to incorporate the heart rate monitor 282 into the handle grips 43, 53, such that the user's heart rate is monitored as he grips the handles 43, 53.

As before, the user 200 sets the user controls 75 and mounts the machine 1. The machine 1 rotates the user 200 to a starting position to begin his exercise routine. As the user 200 performs a number of repetitions of a given exercise (for example, pull-ups) from an initial position, the optical sensor 27 (or 56) senses his head returning to the initial position after each repetition. (Similarly, during other exercises, the other optical sensors 27, 56 detect the position of either the head or feet of the user 200 as he returns to an initial position for each exercise type.) The optical sensors 27, 56 convey this information to the programmable logic control (PLC) of the user control 75, which calculates a "repetition time" measurement and which maintains a count of repetitions completed.

When a heart rate monitor 282 is also used as a feedback mechanism, the heart rate monitor 282 measures the actual heart rate of the user 200 throughout each exercise routine and conveys this information to the PLC of the user control 75. The PLC compares the actual heart rate data to a predefined target heart rate to determine whether any adjustments to the angular orientation of the bench rest assembly 30 are desirable to optimize the user's workout.

The PLC determines whether the user 200 has reached the targeted number of repetitions for a given exercise. If the user 200 has completed the targeted number of repetitions for a given exercise, the PLC then determines whether the user 200 has completed all of the exercises for a given routine (or sequence of exercises). If the user 200 has completed all of the exercises for a given routine, then the machine 1 rotates the user 200 to an upright position, and the exercise session ends. If the user 200 has not completed all of the exercises for a given routine, then the machine 1 rotates the user 200 (if necessary) to a new angular orientation to begin a set of repetitions for the next exercise.

If the user 200 has not yet completed the targeted number of repetitions for the (first) given exercise, the PLC compares a running average of the repetition time for the last five repetitions to a target repetition time. When the average repetition time is less than ninety percent (90%) of the target repetition time, the PLC signals the motor 81 to rotate the bench rest assembly 30 in a five-degree increment to a "more difficult" position. For instance, if the user 200 is performing sit-ups in a slightly head-down position and is completing his repetitions in a shorter time than the target time, the machine 1 may rotate the user 200 to a more inclined position (by five-degrees), thereby increasing the resistance experienced by the user 200. When the average repetition time for the last five repetitions is within plus/minus ten percent (±10%) of the target repetition time, no adjustments to the angular orientation of the bench rest assembly 30 are made.

Finally, when the average repetition time for the last five repetitions is more than 10% longer than the target repetition time, the machine 1 alters the angular orientation of the bench rest assembly 30 to an "easier" position. For instance, using the scenario described above, if the user 200 is performing sit-ups in a slightly head-down position, in which the bench rest assembly 30 is oriented ten degrees from horizontal, and his repetition time increases to more than 10% longer than the target repetition time, the machine 1 rotates the user 200 to a position five degrees from horizontal, thereby reducing the amount of resistance the user 200 experiences.

Similarly, when a heart rate monitor 282 is used, the actual heart rate is compared to a target heart rate to determine whether adjustments to the angular orientation of the bench rest assembly 30 are needed. As with the repetition time measurement, when the average heart rate is less than ninety percent (90%) of the target heart rate, the PLC signals the motor 81 to rotate the bench rest assembly 30 in a five-degree increment to a "more difficult" position. When the heart rate measurement is within plus/minus ten percent (±10%) of the target heart rate, no adjustments to the angular orientation of the bench rest assembly 30 are made. When the heart rate measurement is more than 10% higher than the target heart rate, the machine 1 alters the angular orientation of the bench rest assembly 30 to an "easier" position.

As with the manual and programmed modes of operation, the user 200 may use voice commands to stop the exercise routine—for example, by saying the word "home"—as needed or desired.

The fitness machine 1 may be provided with a microphone (not shown) for receiving voice commands from the user 200, and the PLC may be programmed to interpret and act upon such commands. Representative commands that may be used include "home" (to return the user 200 to an upright position); "up" (to raise the head of the user 200 in five degree increments); and "down" (to lower the head of the user 200 in five degree increments). The user 200 may direct his own course of exercise by using the voice-activated control feature, or may simply incorporate voice commands into a programmed or adaptive routine operated by the machine 1.

Because of its adaptability, the fitness machine 1 is useful for persons of a wide variety of ages and athletic abilities. Once situated on the bench rest assembly 30, the user 200 does not have to alter his position in order to perform his exercise routine. Rather, the user 200 remains in a supine position with his back in contact with the bench rest assembly 30 and allows the machine 1 to alter his angular orientation (if appropriate) for each given exercise. These automated and continuous adjustments of the present fitness machine 1 are particularly beneficial in permitting and encouraging the user 200 to complete a programmed exercise routine without becoming overly fatigued or increasingly frustrated. The varying degrees of difficulty in the exercise routines maintain user interest and motivation over time. Further, the machine 1 may be programmed for both strength and aerobic (cardio) workouts. In a cardio workout, the user 200 may perform low-resistance, short-duration exercises in rapid succession without ever having to dismount the machine 1 for different equipment set-ups.

The control panel 75 may further be used to store user profile information and performance data for multiple users. Specifically, each user 200 of the fitness machine 1 may establish a base-line profile for repetition time and heart rate, based on a certain level of resistance. The user 200 identifies himself (for instance, using a code or key card) before each workout, and, from one workout to the next or over some period of time, the fitness machine 1 may adjust its settings to incrementally increase the resistance experienced by the user 200. Alternately, if a user 200 is unable to perform at a certain resistance level due to physical limitations (such as an injury), the control panel 75 may be programmed to avoid undue exertion on the user 200.

The fitness machine 1 may be easily converted between users 200. Since the fitness machine 1 ends in a standard position (that is, the bench rest assembly 30 is vertically oriented such that the footrest assembly 60 is proximate the floor), subsequent users 200 of the machine 1 have no machine set-ups to perform before exercising. Unlike traditional weight machines, for example, in which the user 200 may have to off-load weights from a prior user, the present fitness machine 1 requires no such modifications.

It is contemplated that the present fitness machine 1 will find utility in home gyms, professional gyms or fitness clubs, physical rehabilitation centers, and hospitals, as well as any other setting where a multi-functional fitness machine 1 is needed. When the fitness machine 1 is to be used in a multi-user environment, such as a fitness or rehabilitation center, it may be desirable to reserve blocks of time for individual users to perform their exercises. The control panel 75 is capable of accepting such programming and of supplying the appropriate profile information for each given user 200.

Another use of the present fitness machine 1 is as a high-quality inversion table. Inversion tables, which may be manually or electrically operated, are commonly used to decompress, stretch, or realign the spine of the user. Inversion tables are also believed to improve circulation and flexibility, reduce back pain, and improve posture. The present fitness machine 1 may be programmed to permit the user 200 to incorporate an inversion period into his exercise routine. Alternately, the user 200 may simply use the fitness machine 1 as an inversion table between exercise routines.

The preceding discussion merely illustrates the principles of the present fitness machine. It will thus be appreciated that those skilled in the art will be able to devise various arrangements, which, although not explicitly described or shown herein, embody the principles of the invention and are included within its spirit and scope. Furthermore, all examples and conditional language recited herein are principally intended expressly to be only for pedagogical purposes and to aid the reader in understanding the principles of the inventions and the concepts contributed by the inventor(s) to furthering the art and are to be construed as being without limitation to such specifically recited examples and conditions.

Moreover, all statements herein reciting principles, aspects, and embodiments of the invention, as well as specific examples thereof, are intended to encompass both structural and functional equivalents thereof. Additionally, it is intended that such equivalents include both currently known equivalents and equivalents developed in the future, i.e., any elements developed that perform the same function, regardless of structure.

This description of the exemplary embodiments is intended to be read in connection with the figures of the accompanying drawings, which are to be considered part of the entire description of the invention. In the description, relative terms such as "lower", "upper", "horizontal", "vertical", "above", "below", "up", "down", "top" and "bottom", as well as derivatives thereof (e.g., "horizontally", "downwardly", etc.) should be construed to refer to the orientation as then described or as shown in the drawing under discussion. These relative terms are for convenience of description and do not required that the apparatus be constructed or operated in a particular orientation, unless otherwise indicated. Terms concerning attachment, coupling, and the like, such as "connected", "attached", or "interconnected", refer to a relationship wherein structures are secured or attached to one another either directly or indirectly through intervening structures, as well as both movable or rigid attachments or relationships, unless expressly described otherwise.

The foregoing description provides a teaching of the subject matter of the appended claims, including the best mode known at the time of filing, but is in no way intended to preclude foreseeable variations contemplated by those of skill in the art.

I claim:

1. A fitness machine comprising:

a base frame having a pair of oppositely disposed vertical side members, wherein the base frame comprises a horizontal platform for contacting the floor and wherein the pair of vertical side members project from opposite sides of the horizontal platform, the vertical side members each carrying a track assembly support plate to which a track assembly is attached;

the track assembly rotatably mounted to the base frame, the track assembly being positioned between the vertical side members;

a drive assembly mounted to the base frame and acting on the track assembly to rotate the track assembly relative to the base frame, wherein the drive assembly comprises driving components and driven components; the driving components being mounted to a first of the vertical side members of the base frame and comprising a direct current motor, a worm gear subassembly, and a main drive axle; the driven components being mounted to a second of the vertical side members of the base frame and comprising a mounting hub and an axle bearing; and the main drive axle extending from the first vertical side to the second vertical side and being positioned beneath the track assembly;

a bench rest assembly slidably mounted within the track assembly, the bench rest assembly supporting a user of the fitness machine in a supine position;

a handle assembly and a foot assembly fixedly attached to opposite ends of the track assembly; and a control system operatively connected to the drive assembly, the control system providing signals to the drive assembly to alter the angular orientation of the bench rest assembly to vary resistance experienced by the user of the fitness machine during an exercise routine.

2. The fitness machine of claim 1, wherein the track assembly is mounted to the track assembly support plates and wherein the track assembly comprises a pair of exterior C-shaped tracks, a pair of outboard-facing interior tracks, and a pair of inboard-facing interior tracks, each of the outboard-facing interior tracks being adjacent to one of the inboard-facing interior tracks to form oppositely directed pairs.

3. The fitness machine of claim 2, wherein the bench rest assembly comprises a plurality of off-set wheel assemblies attached to a bottom surface thereof, the off-set wheel assemblies being rotatable within the inboard-facing interior tracks to slidably mount the bench rest assembly within the track assembly.

4. The fitness machine of claim 2, wherein the handle assembly is mounted to the exterior C-shaped tracks.

5. The fitness machine of claim 2, further comprising a second handle assembly mounted to the outboard-facing pair of interior tracks.

6. The fitness machine of claim 1, further comprising a feedback mechanism in operation with the control system, the feedback mechanism being selected from the group consisting of a plurality of photoelectric sensors mounted to the track assembly at opposite ends thereof, a heart rate monitor removably secured about the chest of the user, and both photoelectric sensors and a heart rate monitor, the feedback mechanism providing signals to the control system.

7. The fitness machine of claim 6, wherein the feedback signals provide a repetition time measurement or a heart rate measurement.

8. The fitness machine of claim 6, wherein the control system is operated in a mode selected from the group consisting of manual control, programmable control based on a predefined routine, adaptive control based on signals from the feedback mechanism, voice-activated control, and combinations thereof.

9. A fitness machine comprising:

a base frame having a horizontal platform for contacting the floor and a pair of vertical side members projecting from opposite sides of the horizontal platform, each of the vertical side members carrying a track assembly support plate;

a drive assembly having driving components and driven components, the driving components being mounted to a first of the vertical side members and the driven components being mounted to a second of the vertical side members, the driving components comprising a direct current motor, a worm gear subassembly, and a main drive axle, the main drive axle extending from the first vertical side to the second vertical side, and the driven components comprising a mounting hub and an axle bearing;

a track assembly rotatably mounted to the track assembly support plates on the vertical side members, the track assembly comprising an interior pair of tracks and an exterior pair of tracks;

a bench rest assembly slidably mounted within the interior tracks of the track assembly;

a handle assembly attached to the exterior tracks of the track assembly;

a footrest assembly attached to the interior tracks of the track assembly; and a control system operatively connected to the drive assembly, the control system including a rotary encoder and a processor, the rotary encoder providing the control system with information on the angular orientation of the bench rest assembly and the control system providing signals to the drive assembly to alter the angular orientation of the bench rest assembly to vary resistance experienced by a user of the fitness machine.

10. The fitness machine of claim 9, wherein the track assembly is rotatable through 360 degrees.

11. The fitness machine of claim 9, wherein the exterior tracks of the track assembly are C-shaped tracks, and wherein the interior tracks of the track assembly are oppositely directed pairs of C-shaped tracks.

12. The fitness machine of claim 9, further comprising a feedback mechanism in operation with the control system, the feedback mechanism being selected from the group consisting of a plurality of photoelectric sensors, a heart rate monitor, and both a plurality of photoelectric sensors and a heart rate monitor.

13. The fitness machine of claim 12, wherein the feedback mechanism comprises a plurality of photoelectric sensors attached to the exterior tracks of the track assembly at opposing ends thereof, the photoelectric sensors communicating a measurement of repetition time to the control system, such that the control system alters the angular orientation of the bench rest assembly based on repetition time feedback from the photoelectric sensors.

14. The fitness machine of claim 12, wherein the feedback mechanism comprises a heart rate monitor attached to a belt, the belt secured to the bench rest assembly and being positioned about the chest of the user, the heart rate monitor being in communication with the control system, such that the control system alters the angular orientation of the bench rest assembly based on feedback from the heart rate monitor.

15. The fitness machine of claim 12, wherein the control system is operated in a mode selected from the group consisting of manual control, programmable control based on a predefined routine, adaptive control based on signals from the feedback mechanism, and voice-activated control.

16. The fitness machine of claim 9, wherein the control system alters the angular orientation of the bench rest assembly repeatedly throughout an exercise session.

17. The fitness machine of claim 9, further comprising a counterweight pulley system, the pulley system supporting the bench rest assembly and being attached to the track assembly between the interior tracks, the pulley system including a counterweight having a weight approximating the weight of the bench rest assembly to counterbalance the bench rest assembly.

18. The fitness machine of claim 9, further comprising a second handle assembly, the second handle assembly being mounted to the interior tracks of the track assembly.

* * * * *